US007650896B2

(12) United States Patent
Kemper et al.

(10) Patent No.: US 7,650,896 B2
(45) Date of Patent: Jan. 26, 2010

(54) APPARATUS FOR HOLDING NURSING BOTTLE COMPONENTS IN A DISHWASHER

(75) Inventors: Bernard J. Kemper, Bonne Terre, MO (US); David E. Hays, Bonne Terre, MO (US)

(73) Assignee: Handi-Craft Company, St. Louis, MO (US)

( * ) Notice: Subject to any disclaimer, the term of this patent is extended or adjusted under 35 U.S.C. 154(b) by 334 days.

(21) Appl. No.: 11/411,368

(22) Filed: Apr. 26, 2006

(65) Prior Publication Data

US 2007/0261724 A1 Nov. 15, 2007

(51) Int. Cl.
*B08B 3/02* (2006.01)

(52) U.S. Cl. ..... 134/135; 134/166 R; 134/170

(58) Field of Classification Search ..... 134/135, 134/166 R, 170, 184, 198
See application file for complete search history.

(56) References Cited

U.S. PATENT DOCUMENTS

| | | | | |
|---|---|---|---|---|
| 2,141,516 | A | 12/1938 | Clements | |
| 2,472,028 | A | 5/1949 | Son | |
| 3,634,937 | A * | 1/1972 | Green | 434/263 |
| 4,193,588 | A | 3/1980 | Doneaux | |
| 4,498,594 | A | 2/1985 | Elder | |
| 4,512,489 | A | 4/1985 | Green | |
| 4,544,529 | A | 10/1985 | Hoeck | |
| 4,732,291 | A | 3/1988 | McConnell | |
| 4,748,993 | A | 6/1988 | Llewellyn | |
| 4,762,688 | A * | 8/1988 | Berry, Jr. | 422/310 |
| 4,830,200 | A | 5/1989 | Zambano | |
| 4,836,392 | A | 6/1989 | Constantino | |
| 4,909,401 | A | 3/1990 | McConnell | |
| 5,211,191 | A | 5/1993 | Brown | |
| 5,213,776 | A | 5/1993 | Maniero | |
| 5,518,115 | A * | 5/1996 | Latulippe | 206/370 |

(Continued)

FOREIGN PATENT DOCUMENTS

| | | | |
|---|---|---|---|
| FR | 2 769 841 | * | 4/1999 |

(Continued)

OTHER PUBLICATIONS

International Search Report for PCT/US07/67465, dated Aug. 19, 2008, 8 pages.

(Continued)

*Primary Examiner*—Frankie L Stinson
(74) *Attorney, Agent, or Firm*—Armstrong Teasdale LLP

(57) ABSTRACT

In an apparatus for holding components of a nursing bottle assembly in a dishwasher, a loading member has a first opening sized and configured for receiving a portion of a first component of the bottle assembly therein to seat the first component on the loading member, and a second opening separate from the first opening. The second opening is sized and configured for receiving a portion of the second component of the bottle assembly therein to seat the second component on the loading member. The first and second openings differ in at least one characteristic indicative of the respective first and second components to facilitate identification of the first opening as being the proper location on the loading member for placement of the first component and of the second opening as being the proper location on the loading member for placement of the second component.

20 Claims, 24 Drawing Sheets

U.S. PATENT DOCUMENTS

| | | | | |
|---|---|---|---|---|
| 5,690,852 | A | 11/1997 | Saito | |
| 5,732,821 | A * | 3/1998 | Stone et al. | 206/370 |
| 5,840,261 | A * | 11/1998 | Monch | 422/300 |
| 6,426,041 | B1 * | 7/2002 | Smith | 422/28 |
| 6,814,091 | B2 | 11/2004 | McConnell | |
| 6,910,488 | B2 * | 6/2005 | McConnell et al. | 134/135 |
| 6,915,808 | B2 | 7/2005 | McConnell | |
| 7,478,642 | B2 | 1/2009 | Koch et al. | |
| 2003/0205258 | A1 | 11/2003 | McConnell | |
| 2005/0000554 | A1 | 1/2005 | Curran | |
| 2005/0158222 | A1 * | 7/2005 | Bettenhausen et al. | 422/300 |
| 2006/0065666 | A1 * | 3/2006 | Dunn et al. | 220/676 |
| 2006/0266667 | A1 * | 11/2006 | Mendenhall et al. | 206/427 |
| 2007/0125725 | A1 * | 6/2007 | Kemper et al. | 211/41.3 |

FOREIGN PATENT DOCUMENTS

| | | | |
|---|---|---|---|
| JP | 2005-185664 | * | 7/2005 |

OTHER PUBLICATIONS

Munchkin Deluxe Dishwasher Basket, 11 photos (admitted prior art), 2006.

* cited by examiner

APPARATUS FOR HOLDING NURSING BOTTLE COMPONENTS IN A DISHWASHER

FIELD OF THE INVENTION

The present invention relates generally to apparatus for holding components in a dishwasher during cleaning, and more particularly to apparatus for holding one or more components of a nursing bottle assembly in a dishwasher during cleaning.

BACKGROUND OF THE INVENTION

Nursing bottle assemblies are commonly used for feeding infants and typically comprise a bottle and various components such as a nipple, collar and a cap. For some commercially available bottle assemblies, such as that available from Handi-Craft Company of St. Louis, Mo. under the tradename DR. BROWN'S NATURAL FLOW, additional components are provided. To clean these bottle assemblies, the bottle components are disassembled from the bottle and the bottle and various components are then loaded individually into a standard dishwasher.

In particular, it is commonplace for the bottles to be placed on the upper rack of the dishwasher along with glasses and cups, and to load the bottle components in bulk (and often crammed) into the utensil basket of the dishwasher. However, some manufacturers of nursing bottle assemblies recommend that the components are not placed in the lower rack of the dishwasher such as in the utensil basket. Instead, these manufacturers recommend that the components are placed in the top rack of the dishwasher so that they are positioned away from the dishwasher's heating elements. As a result, the bottle components may be loaded into a dishwasher safe basket designed for holding such components, and the basket placed on the top rack of the dishwasher.

Loading the, bottle components into a utensil basket or separate dishwasher basket in this manner can result in a less than desired cleaning of the bottle components. In particular, some bottle components, upon loading or upon movement in the basket during cleaning, end up being surrounded or otherwise shielded by the other bottle components in the basket to the point that the shielded components are not cleaned as well. It is also possible that some of the bottle components may become nested within other components in the basket. Nesting occurs when one component is receiving into or partially received into another often larger or like-shaped component. For example, a nipple of the bottle can become nested within a cap or another nipple. When this occurs, an effective cleaning of both components is compromised.

There is a need, therefore, for a dishwasher safe apparatus for holding bottle components separate from each other and against movement in or on the apparatus during cleaning in a dishwasher.

SUMMARY OF THE INVENTION

In one aspect, the present invention is directed to apparatus for holding components of a nursing bottle assembly in a dishwasher. The nursing bottle assembly comprises a bottle, at least a first component adapted for assembly with the bottle and at least a second component different from the first component and adapted for assembly with the bottle. The apparatus generally comprises a loading member having a first opening sized and configured for receiving a portion of the first component therein to seat the first component on the loading member, and a second opening separate from the first opening. The second opening is sized and configured for receiving a portion of the second component therein to seat the second component on the loading member. The first and second openings differ in at least one characteristic indicative of the respective first and second components to facilitate identification of the first opening as being the proper location on the loading member for placement of the first component and of the second opening as being the proper location on the loading member for placement of the second component.

In another aspect, the apparatus for holding components of a nursing bottle assembly in a dishwasher generally comprises a loading member having a first opening sized and configured exclusively for receiving a portion of the first component therein to seat the first component on the loading member, and a second opening separate from the first opening. The second opening is sized and configured exclusively for receiving a portion of the second component therein to seat the second component on the loading member. A retaining member is moveable relative to the loading member between an open position to permit loading of the first and second components onto the loading member and a closed position for use of the apparatus in the dishwasher during operation thereof. In the closed position, the retaining member contacts the first and second components such that the loading member and the retaining member together generally inhibit movement of the first and second components relative to the loading member and the retaining member during operation of the dishwasher.

In still another aspect, the apparatus for holding components of a nursing bottle assembly in a dishwasher generally comprises a loading member having a first opening sized and configured for receiving a portion of the first component therein to seat the first component on the loading member, and a second opening separate from the first opening. The second opening is sized and configured for receiving a portion of the second component therein to seat the second component on the loading member. Indicia on the loading member facilitates identification of the first opening as being the proper location on the loading member for placement of the first component and of the second opening as being the proper location on the loading member for placement of the second component.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
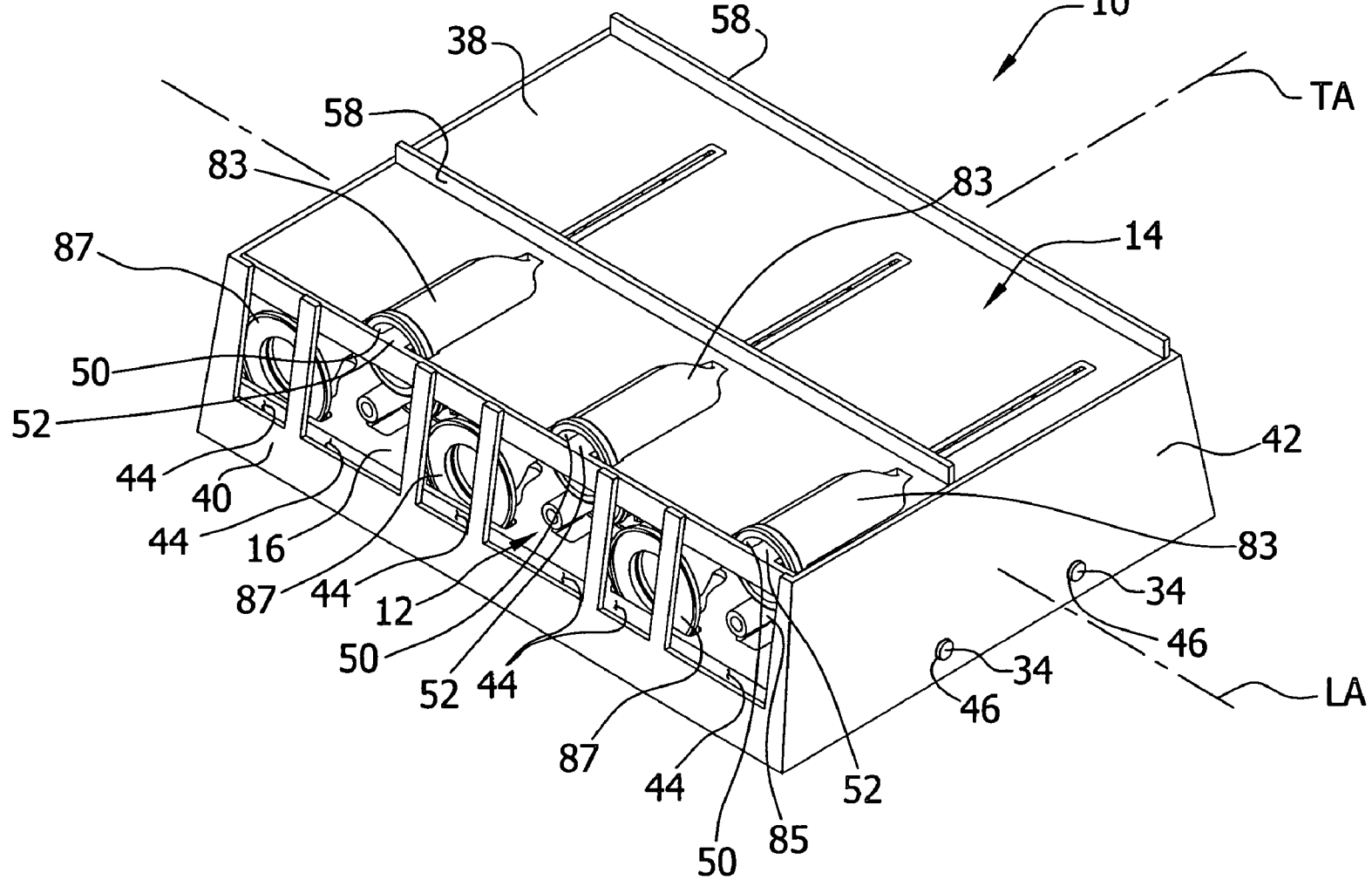
FIG. 1 is a perspective view of one embodiment of apparatus of the present invention for holding one or more components of a nursing bottle assembly.

With reference now to the drawings and in particular to FIG. 1, one embodiment of apparatus of the present invention for holding one or more components of one or more nursing bottle assemblies is indicated generally at 10. As used herein, the term "nursing bottle assembly" refers generally to a bottle and its associated components such as nipple, collar, cap and the like that are assembled with the bottle for storage and/or use. Accordingly, the term "bottle component" as used herein refers to a component of the nursing bottle assembly other than the bottle itself.

Figure 2:
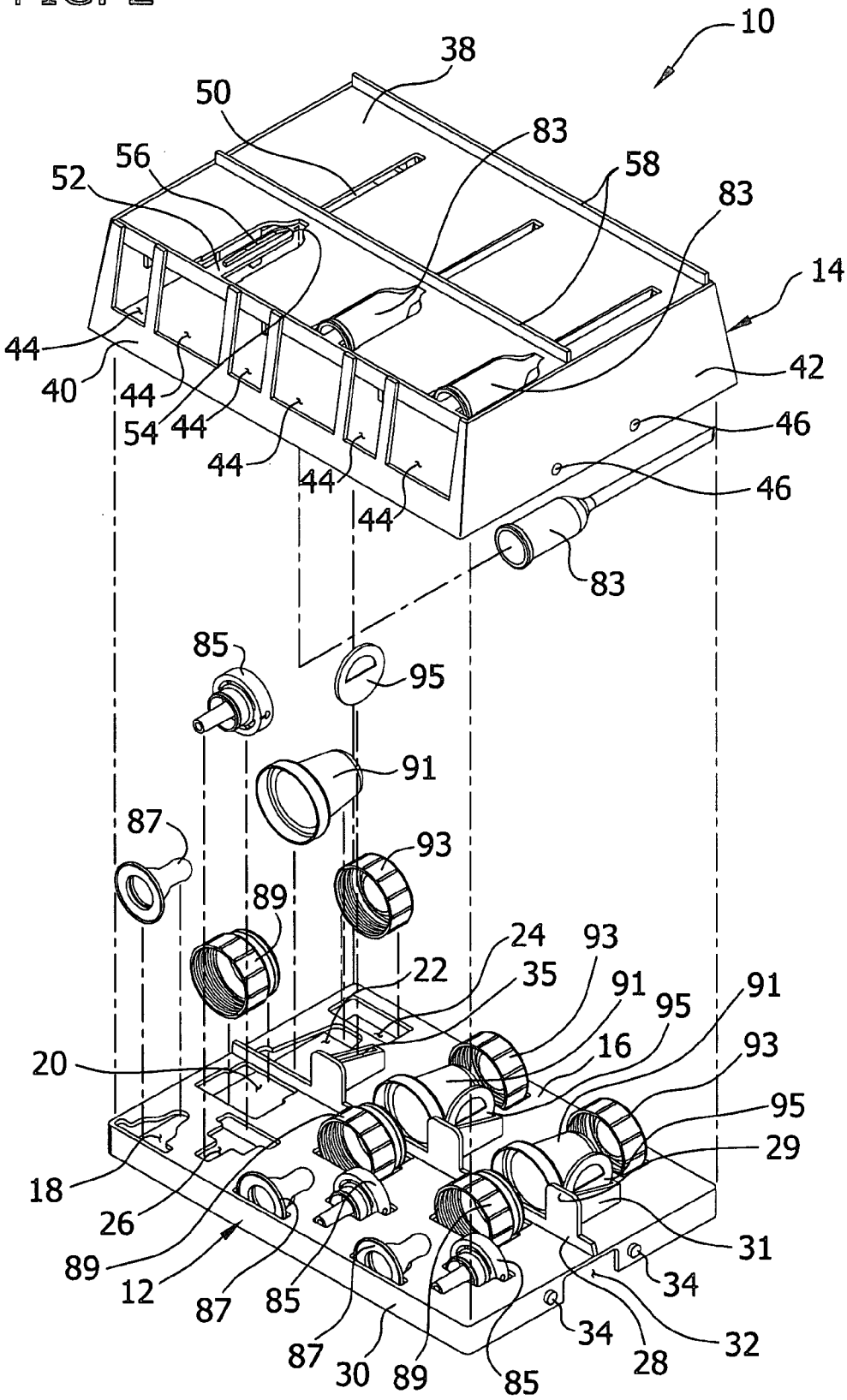
FIG. 2 is an exploded perspective view of the apparatus of FIG. 1 with various components of one nursing bottle assembly exploded from a loading member of the apparatus while the components of two other nursing bottle assemblies are shown arranged on the loading member.
Figure 11:
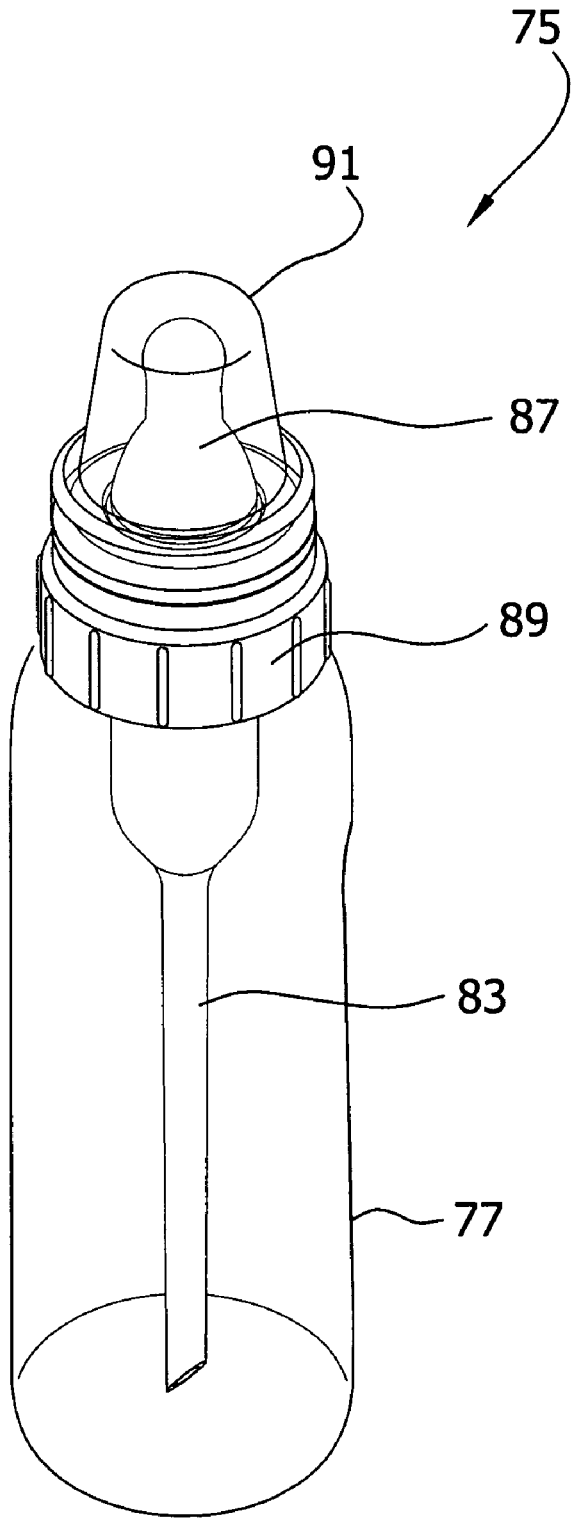
FIG. 11 is a perspective view of a nursing bottle assembly in an assembled condition.
Figure 12:
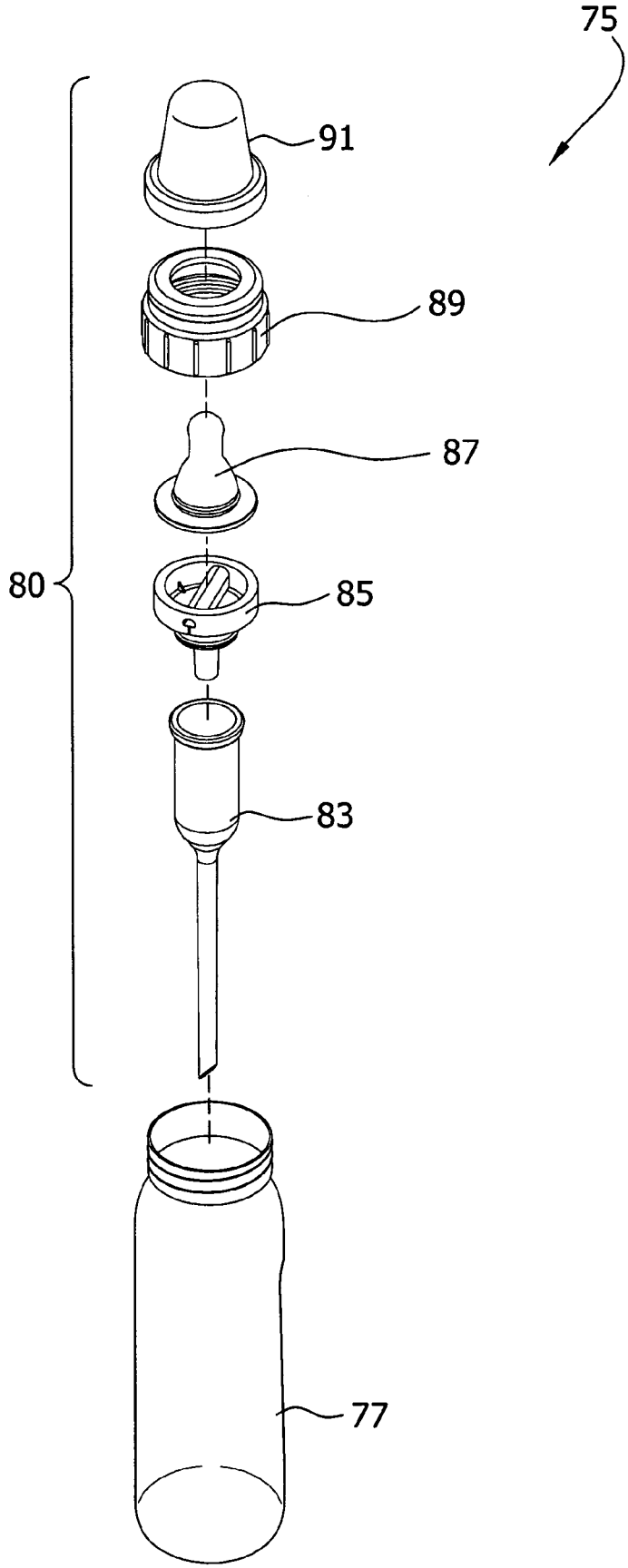
FIG. 12 is an exploded perspective view of the nursing bottle of FIG. 11.
Figure 13:
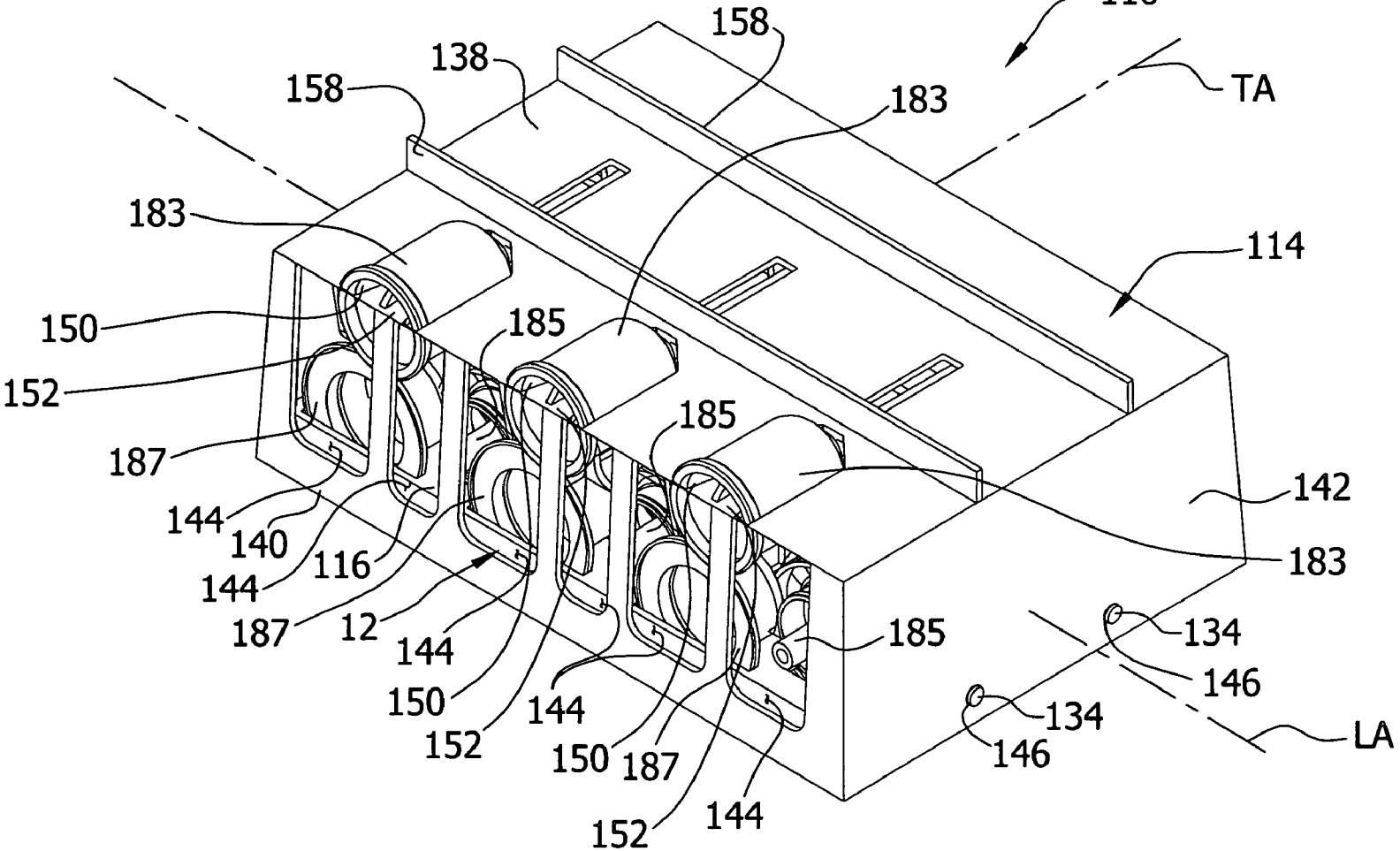
FIG. 13 is a perspective view of a second embodiment of apparatus for holding one or more components of a nursing bottle assembly.
Figure 14:
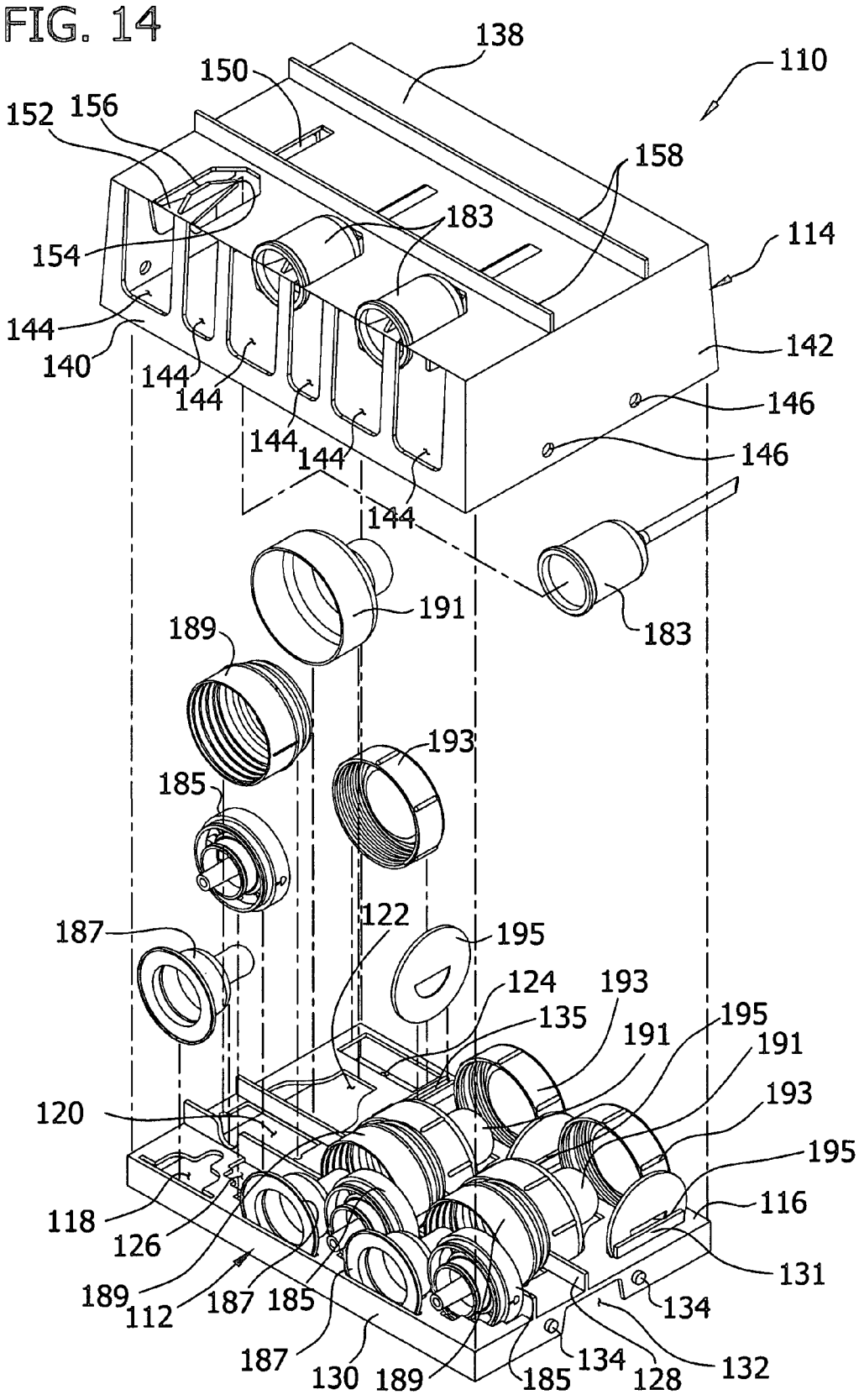
FIG. 14 is an exploded perspective view of the apparatus of FIG. 13 with various components of one nursing bottle assembly exploded from a loading member of the apparatus while the components of two other nursing bottle assemblies are arranged on the loading member.
Figure 15:
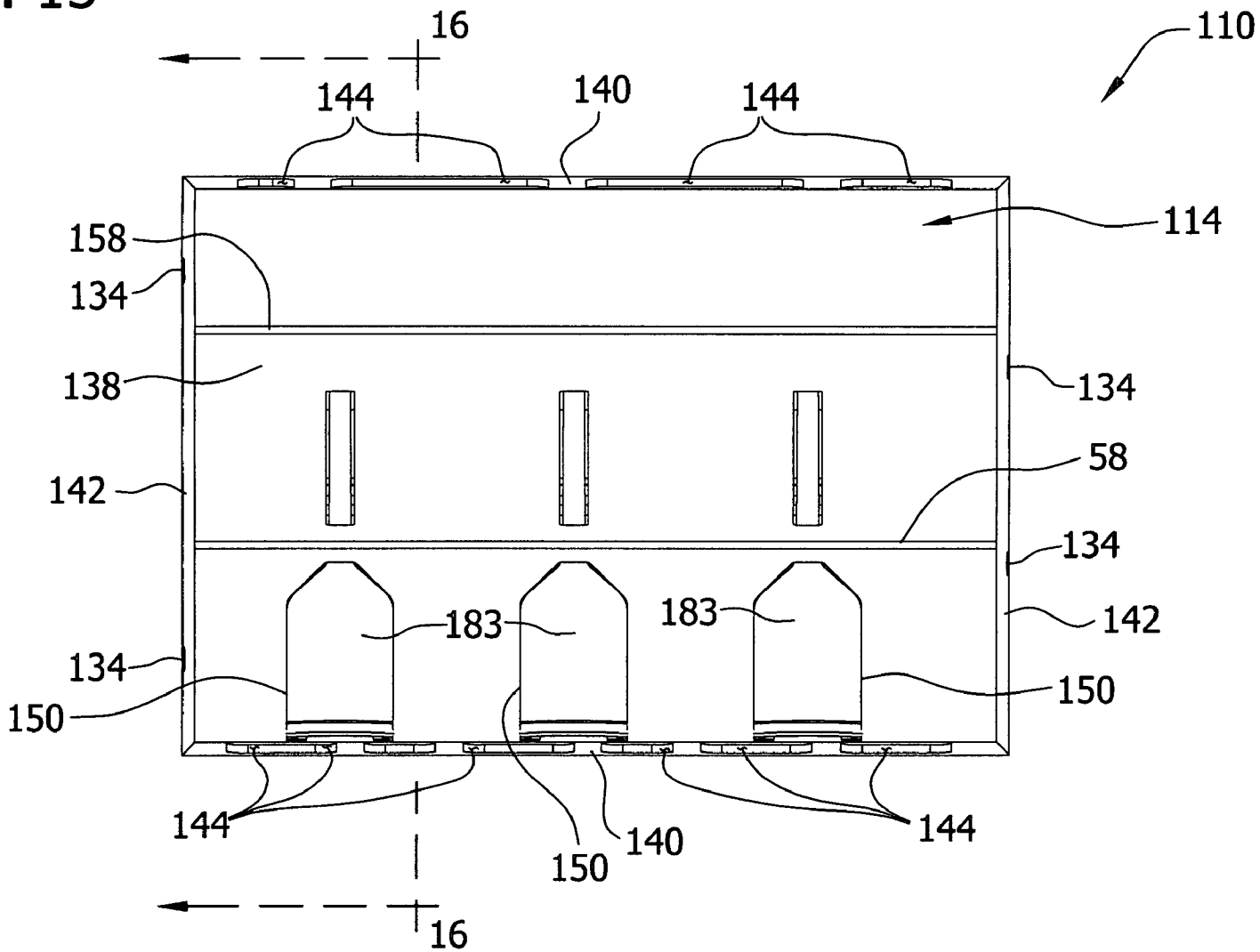
FIG. 15 is a top view of the apparatus of FIG.13.
Figure 16:
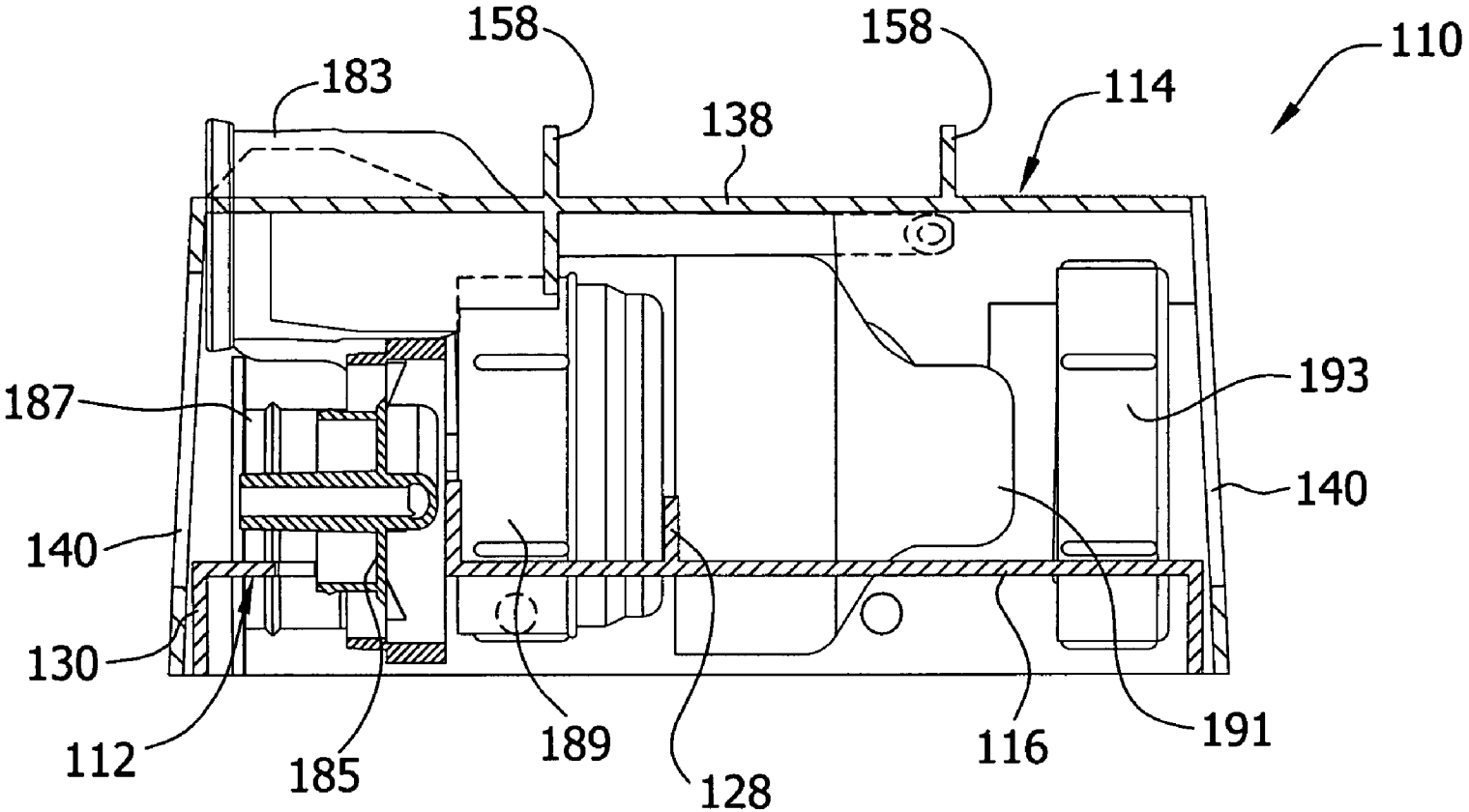
FIG. 16 is a cross-section taken in the plane of line 16-16 of FIG. 15.
Figure 17:
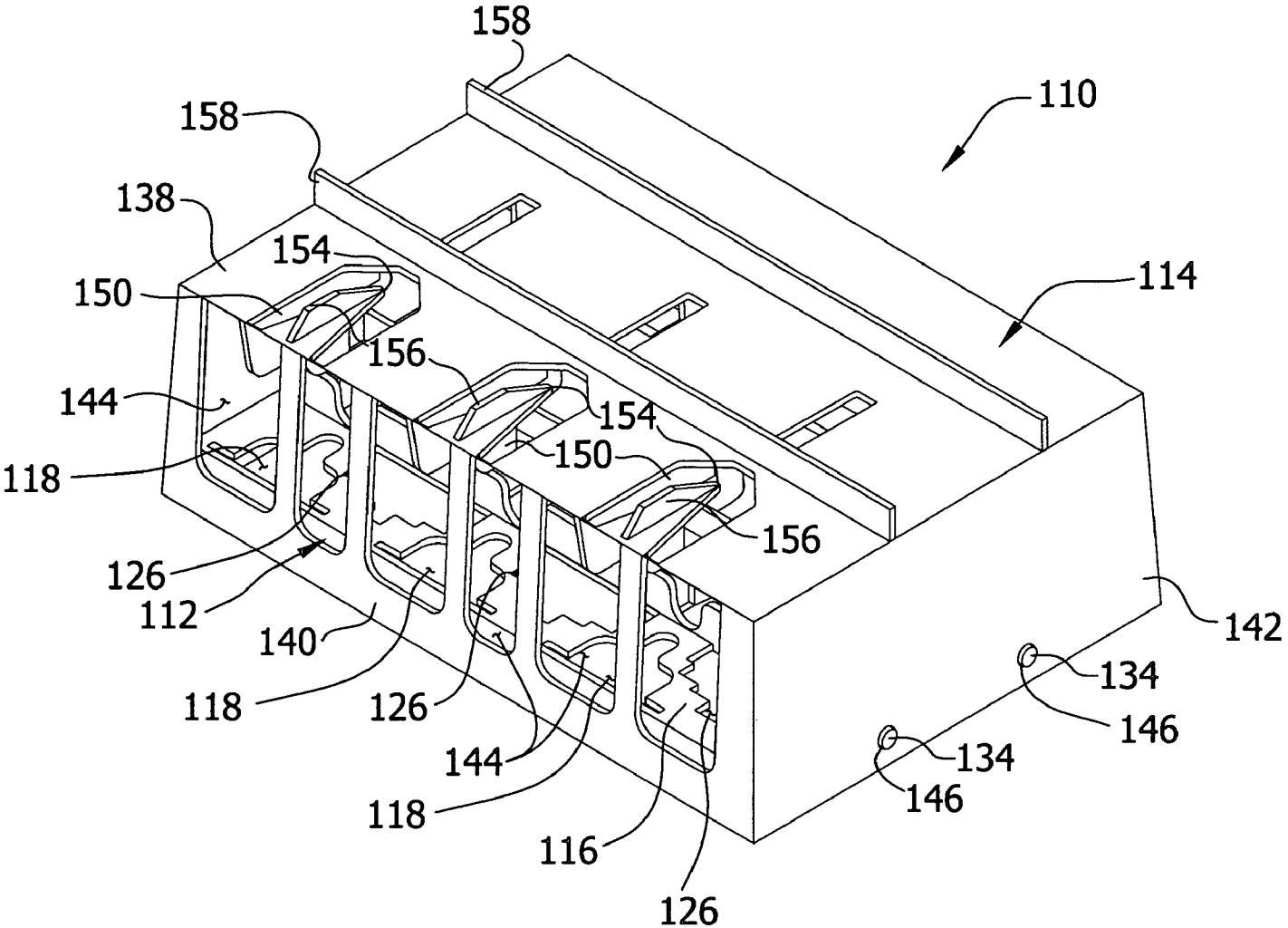
FIG. 17 is a perspective view of the apparatus of FIG. 13 with the various components of the nursing bottle assemblies removed from the apparatus.
Figure 18:
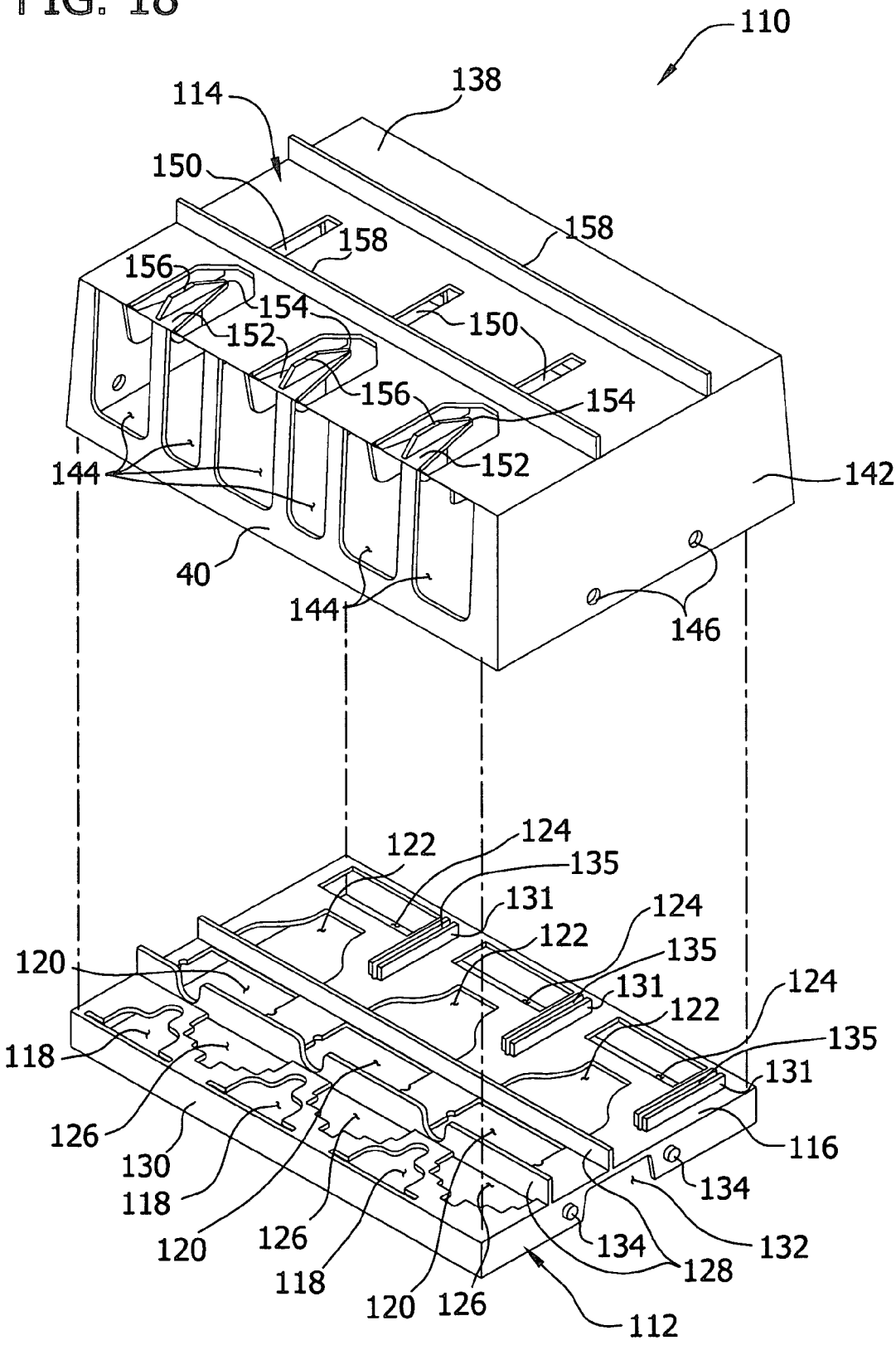
FIG. 18 is an exploded perspective view thereof.
Figure 19:
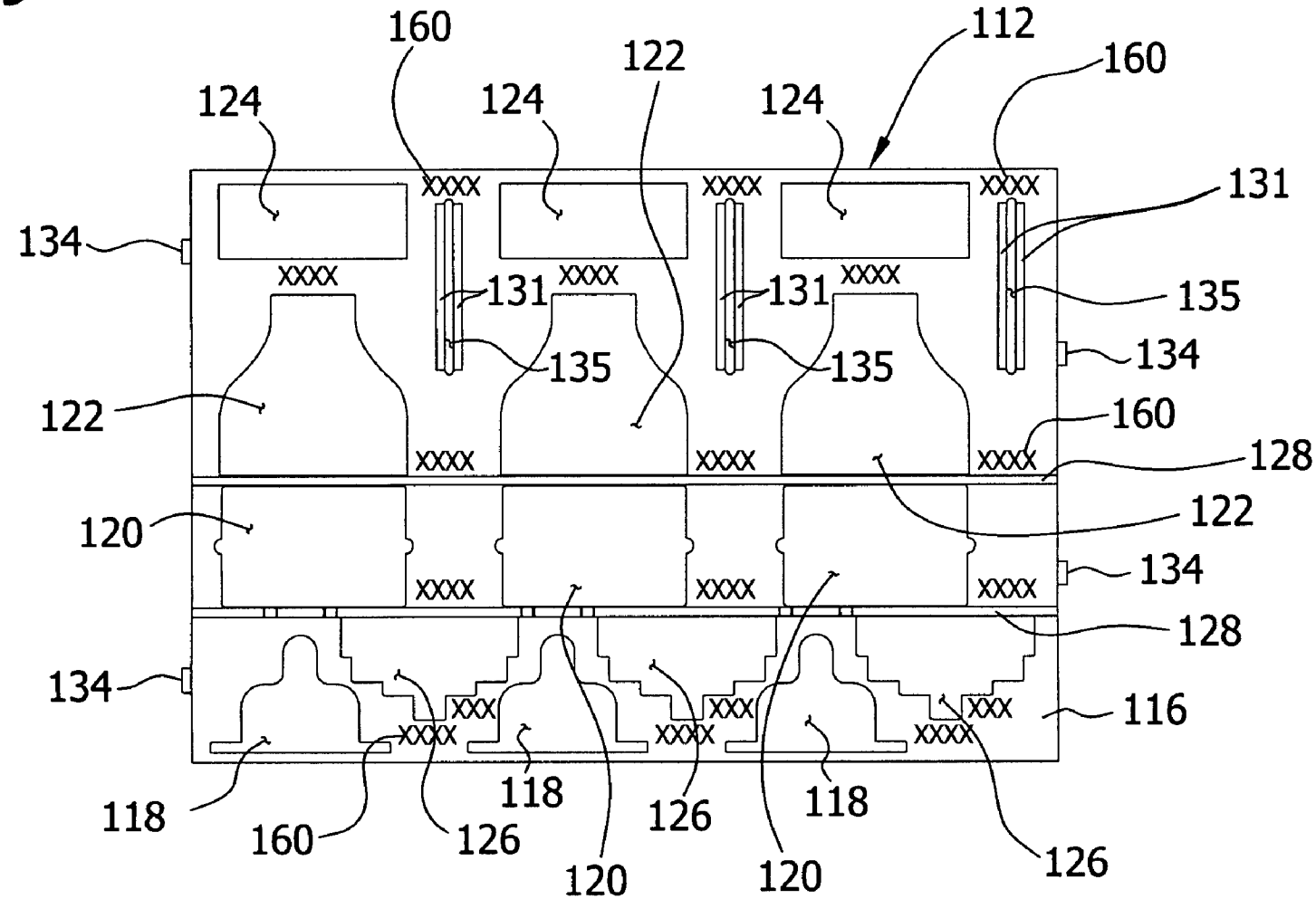
FIG. 19 is a top plan view of the loading member of the apparatus.
Figure 20:
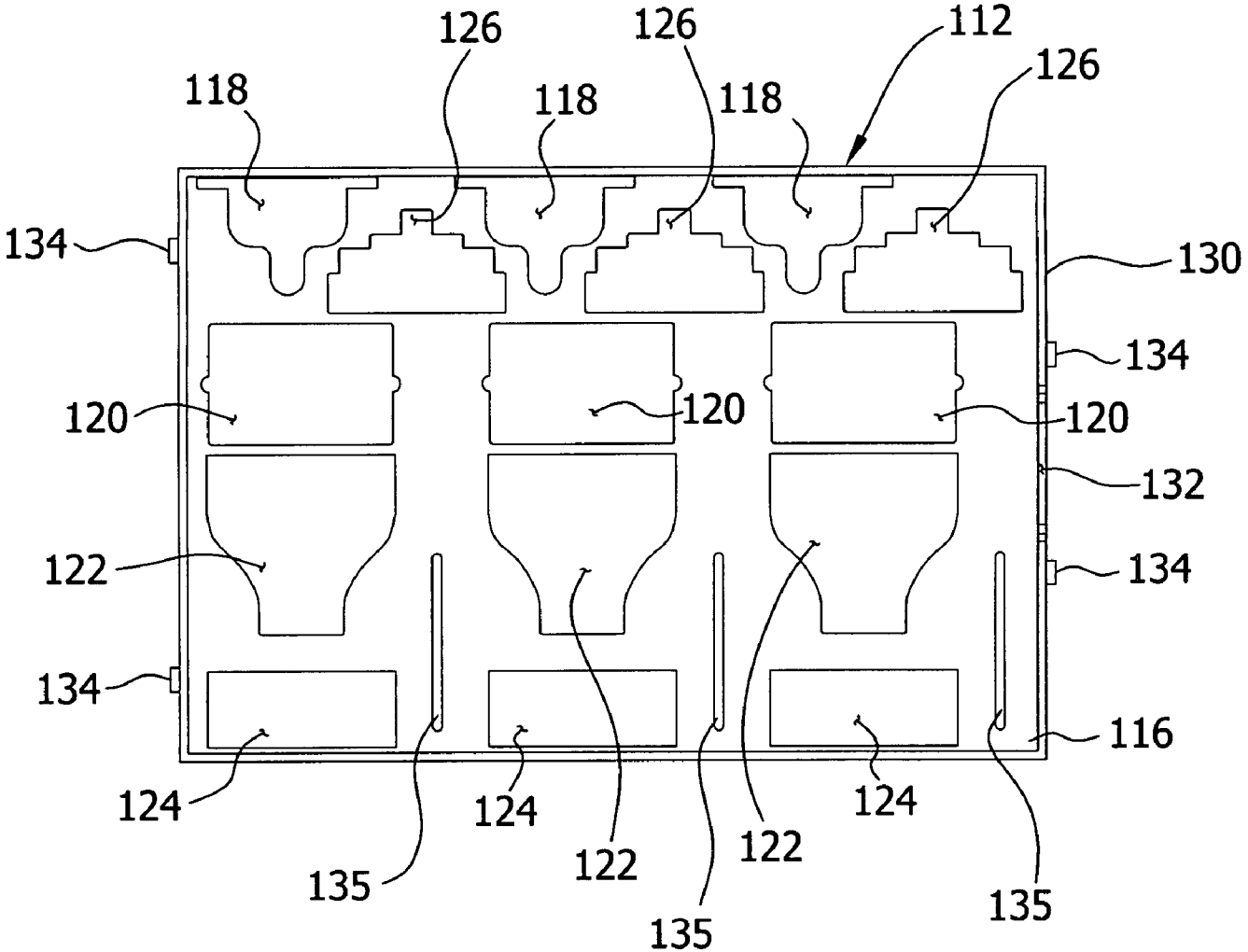
FIG. 20 is a bottom plan view of the loading member.
Figure 21:
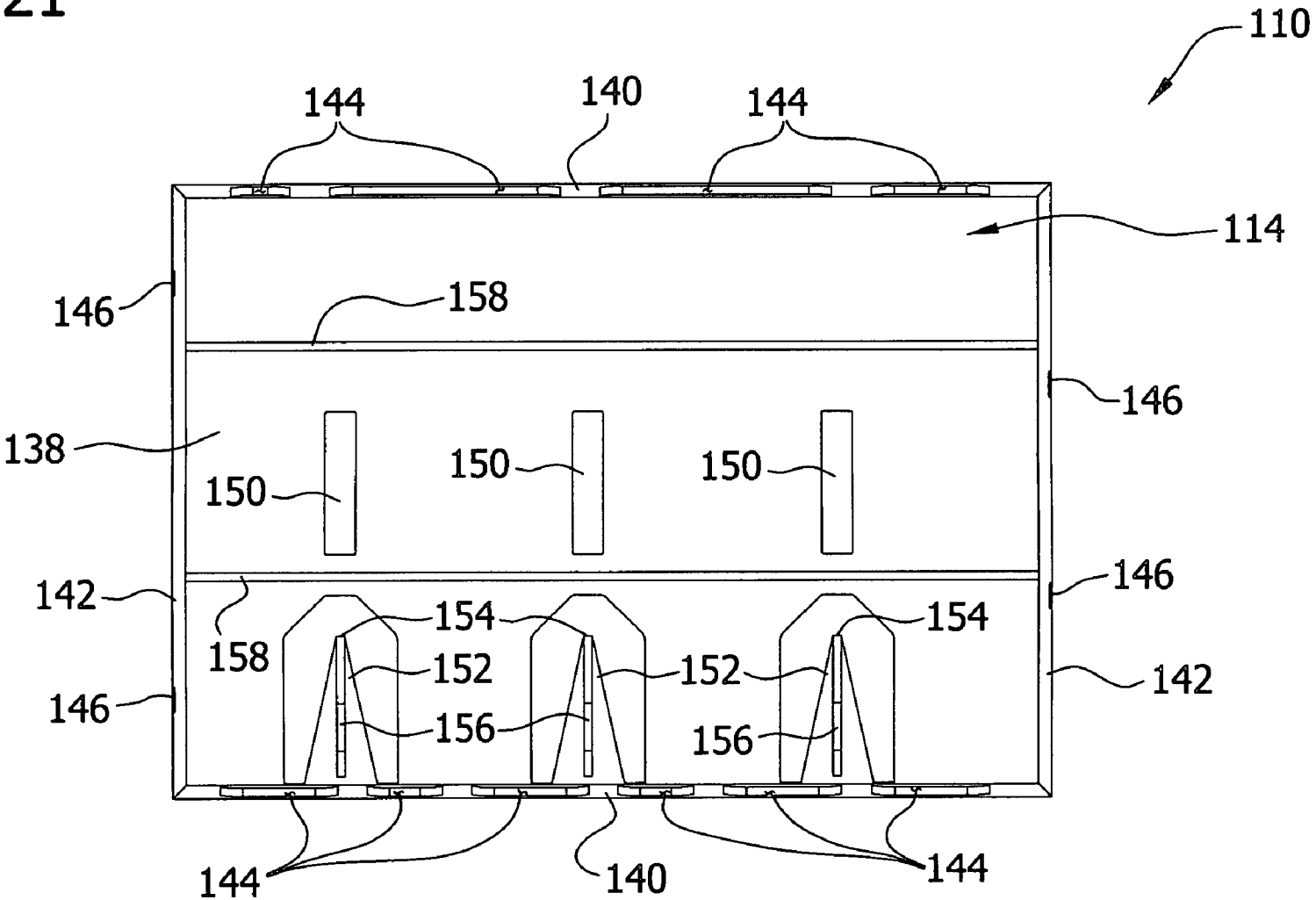
FIG. 21 is a top view of a retaining member of the apparatus.
Figure 22:
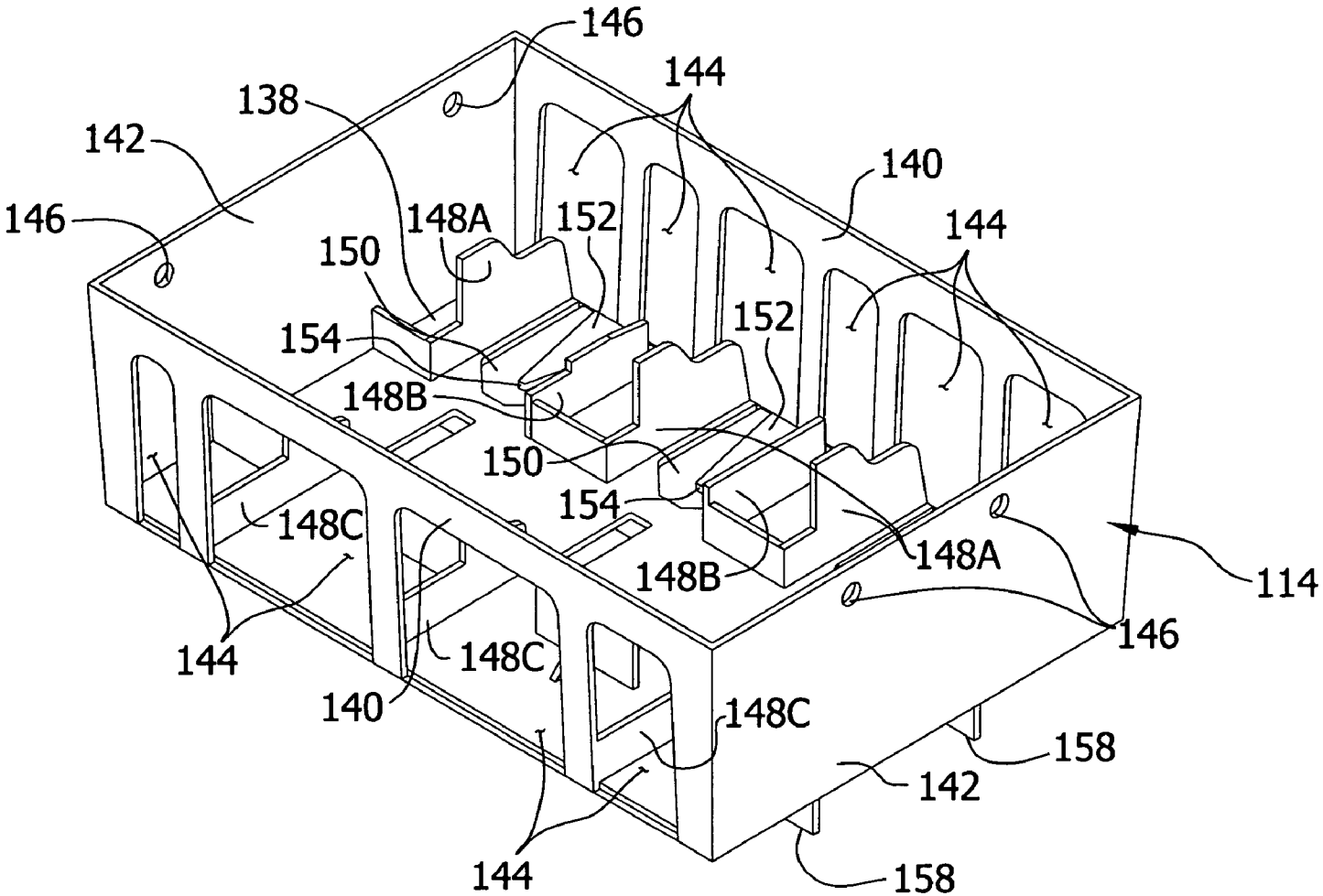
FIG. 22 is a perspective view of the retaining member as illustrated from the bottom of the assembly.
Figure 23:
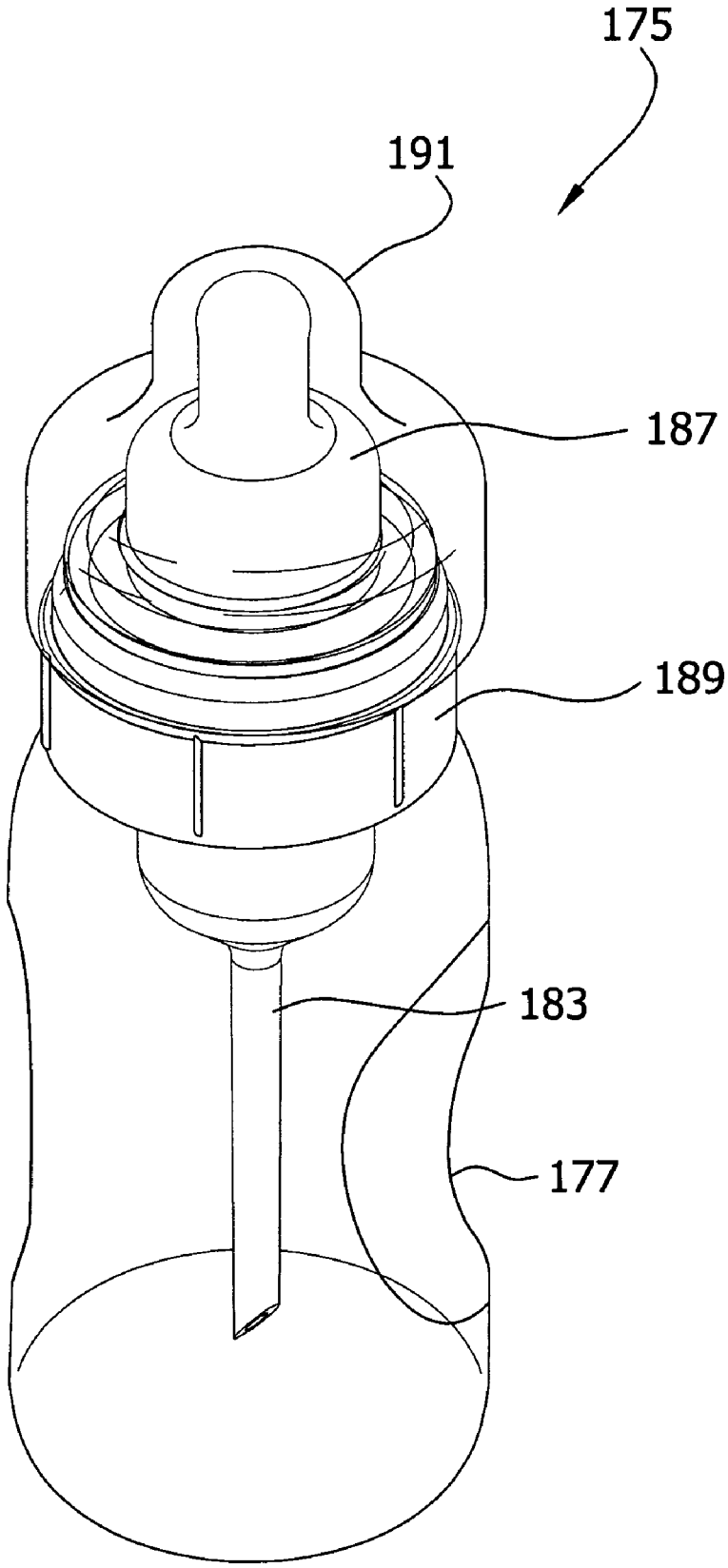
FIG. 23 is a perspective view of another nursing bottle assembly in an assembled condition.
Figure 24:
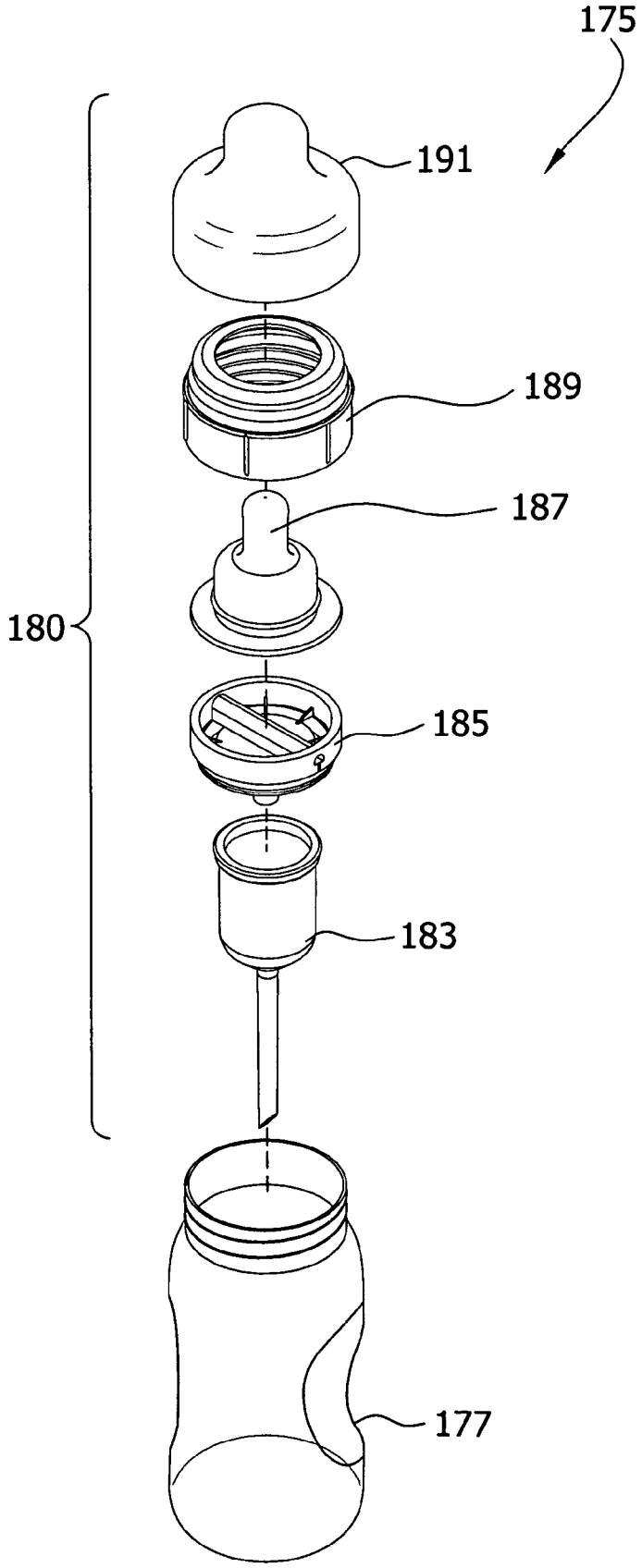
FIG. 24 is an exploded perspective view of the nursing bottle of FIG. 23.

As one example, with reference to FIGS. 11 and 12, the apparatus of the illustrated embodiment is suitably constructed to accommodate the bottle components of a nursing bottle assembly 75 that is commercially available from Handi-Craft Company of St. Louis, Mo. under the tradename DR. BROWN'S NATURAL FLOW. This bottle assembly 75 is particularly configured to vent the interior of the bottle during use and, in addition to a bottle 77, includes bottle components 80 such as a cap 91, collar 89, nipple 87, vent insert 85 and elongate tube 83 that are all subject to cleaning. Additional bottle components that may be used with the bottle assembly 75 are illustrated in FIG. 2 and include a closure travel cap 93, which is used in place of the nipple 87, collar 89, vent insert 85, elongate tube 83, and cap 91 to seal the contents of the bottle during travel or storage, or a disk 95, which can be inserted between nipple 87 and vent insert 85 for sealing the contents of the bottle during travel or storage. It is understood, however, that the apparatus 10 may be configured to accommodate one or more bottle components of other nursing bottle assemblies without departing from the scope of this invention.

More suitably, the apparatus 10 is configured to accommodate all of the bottle components of multiple nursing bottle assemblies. For example, the apparatus 10 illustrated in FIG. 1 is configured to accommodate all of the bottle components 80 of three of the nursing bottle assemblies 75 illustrated in FIGS. 11 and 12. It is understood, however, that the apparatus 10 may be configured to receive the bottle components of one, two or more than three nursing bottle assemblies and remain within the scope of this invention.

With particular reference to FIGS. 1-4, the illustrated apparatus 10 comprises a loading member, generally indicated at 12, on which the bottle components 80 to be cleaned are initially loaded, and a retaining member, indicated generally at 14 adapted for being held in assembly with the loading member during cleaning and configured to hold the bottle components 80 separate from each other and generally stationary during cleaning in the dishwasher. The apparatus 10 is suitably sized and shaped for placement in an upper rack of the dishwasher.

As illustrated in FIGS. 2 and 6-8, the loading member 12 comprises a generally rectangular panel 16 having a skirt 30 depending therefrom and extending about its periphery. The skirt 30 may be formed integrally with the panel 16, such as by being molded therewith, or the skirt may be formed separate from the panel and adhered, welded, bonded or otherwise suitably secured to the panel. The panel 16 of the loading member has an upper, or loading surface onto which the bottle components 80 of the nursing bottle assemblies 75 are arranged to properly load the bottle components into the apparatus 10.

In particular, multiple openings 18, 20, 22, 24, 26 are formed in the panel 16 for positive seating of the various bottle components 80 on the loading surface defined by the panel. One set of openings 18 (broadly, first openings) is sized and configured for receiving a portion of the one bottle components 80, such as the nipple 87. Another set of openings 20 (broadly, second openings) is sized and configured for receiving a portion of a different one of the bottle components 80, such as the collar 89. The other sets of openings 22, 24, 26 are each sized and configured for receiving a portion of the cap 91, closure 93 and vent insert 85, respectively.

In one embodiment, the openings 18, 20, 22, 24 and 26 each differ in at least one characteristic that is indicative of the particular bottle component 80 that is to be seated in the respective opening. That is, each of the openings 18, 20, 22, 24, 26 is thus associated with a respective bottle component such that the person loading the apparatus 10 can readily identify in which opening a particular bottle component 80 is to be placed. For example, in the illustrated embodiment (FIG. 6), the openings 18, 20, 22, 24, 26 have different shapes, with each of the openings being configured to have a shape that corresponds generally to the profile of the respective bottle component 80 that is to be seated in the opening. For example, the openings 18 of the illustrated embodiment are each shaped to correspond generally to the profile of the nipple 87 while the openings 20 are each shaped to correspond generally to the profile of the collar 89. It is understood, however, that the openings 18, 20, 22, 24, 26 are each sized smaller than the actual profile of the respective bottle component 80 so that the bottle component properly seats on the panel 16 partially within the opening without falling entirely through the opening.

It is understood that the openings 18, 20, 22, 24, 26 may be shaped other than to correspond generally to the profiles of the respective bottle components 80 and still differ in at least one characteristic that can be used by the person loading the apparatus 10 to identify the proper opening in which a particular bottle component is to be placed. For example, the openings 18, 20, 22, 24, 26 may each differ in shape and/or size, with each of the different shapes and/or sizes being associated with a different one of the bottle components 80.

Figure 7:
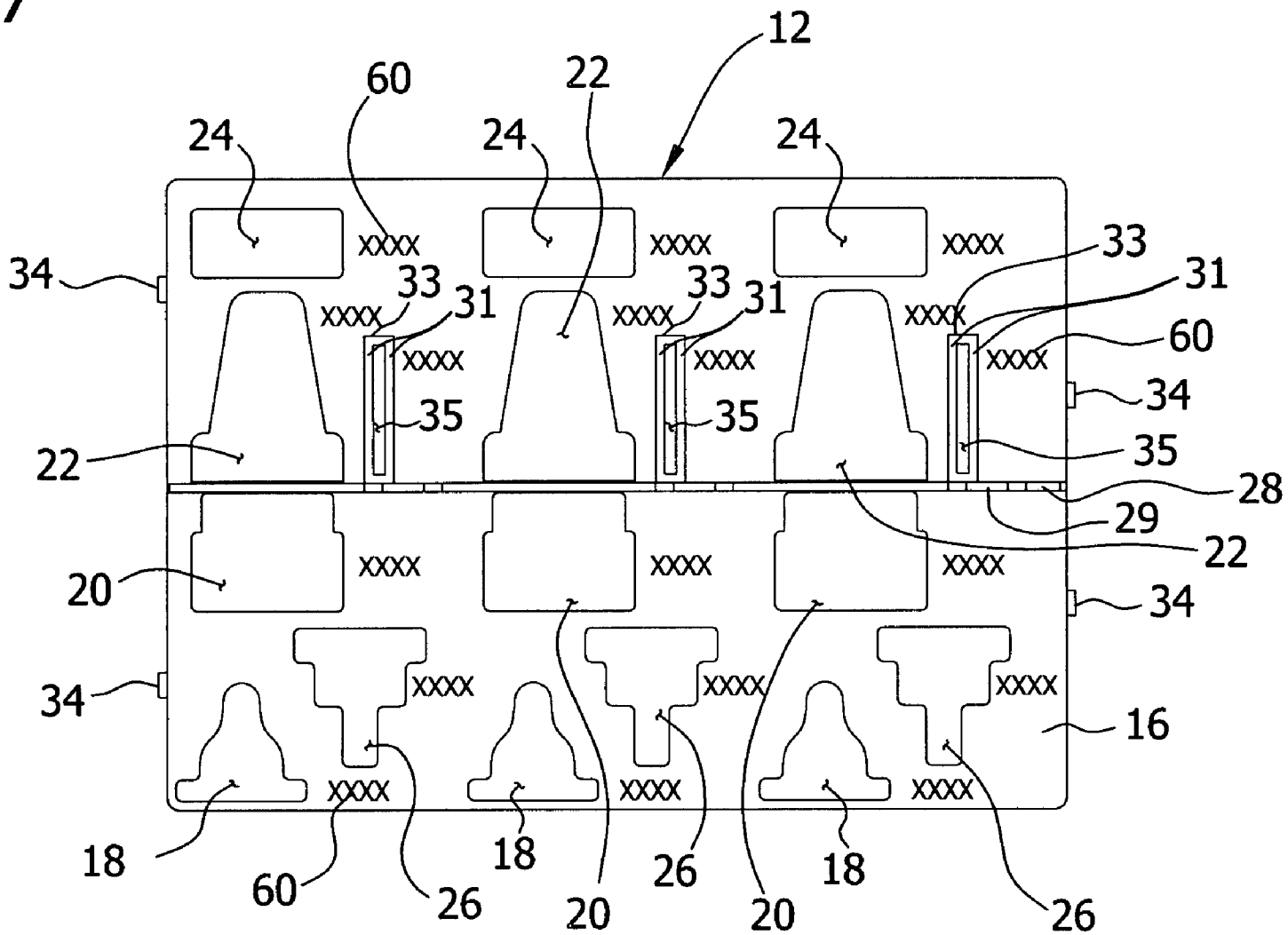
FIG. 7 is a top plan view of the loading member of the apparatus.

With reference to FIG. 7, in other examples indicia (indicated as 60 in FIG. 7) such as color, graphics and/or alphanumerics may be applied to the panel 16 to indicate to location on the loading surface at which each of the bottle components 80 is to be placed. In one such embodiment, each of the openings 18, 20, 22, 24 and 26 may be outlined by a different color that is associated with the particular bottle component 80 to be placed in the opening. In another such embodiment, a graphic representation or image of the bottle component 80 to be placed in a particular one of the openings 18, 20, 22, 24, 26 may appear on the panel 16 adjacent to the respective opening. In still another such embodiment, the name of the bottle component 80, or a number associated with the bottle component 80 to be placed in a particular one of the openings 18, 20, 22, 24, 26 may appear on the panel adjacent to the respective opening. In still yet another embodiment (not shown), an outline of each component may be disposed around the respective openings to more closely resemble the full size and/or shape of each component.

Figure 6:
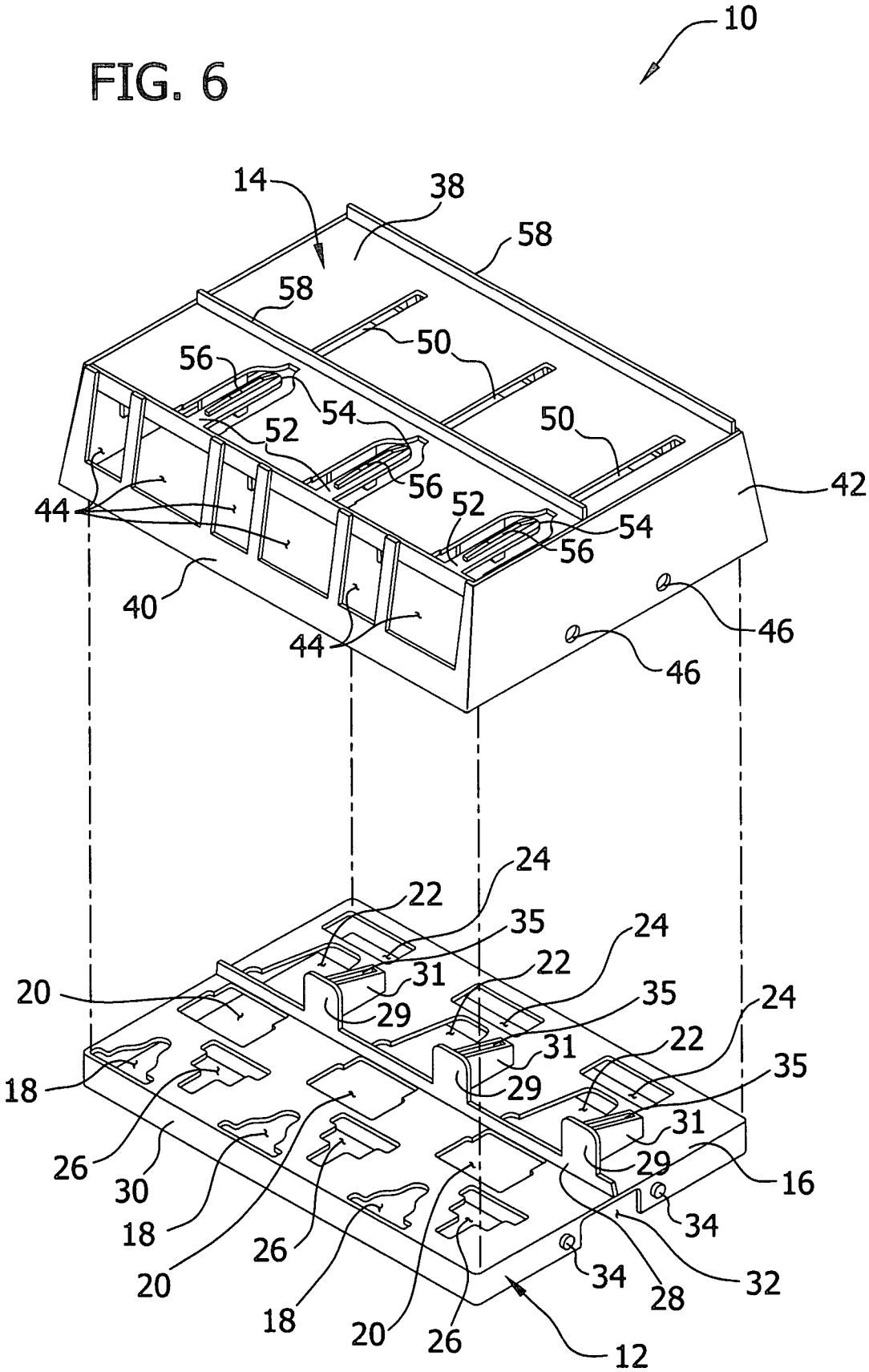
FIG. 6 is an exploded perspective view thereof.

As illustrated in FIG. 6, a rib 28 extends up from the loading surface of the panel 16 generally along a longitudinal axis LA (FIG. 1) of the loading member 12. The rib 28 extends from approximately one end of the loading member 12 to the other. Three longitudinally spaced tabs 29 extend up from the loading surface of the panel along the rib 28 (FIG. 6). For example, the tabs 29 may be formed integrally with the rib 28, or the rib may be formed from multiple pieces that are spaced apart to accommodate positioning of the tabs 29 between the rib pieces. Extending transversely outward from each of the tabs 29 is a pair of spaced-apart tapered walls 31. An end wall 33 spans the spaced-apart tapered walls 31 at their ends opposite from the tabs 29 such that the tabs, tapered walls 31, and end wall 33 define an elongate slot 35 sized and shaped for receiving a disk 95 (FIG. 2) of the bottle assembly 75 (FIG. 11 or 12).

Figure 4:
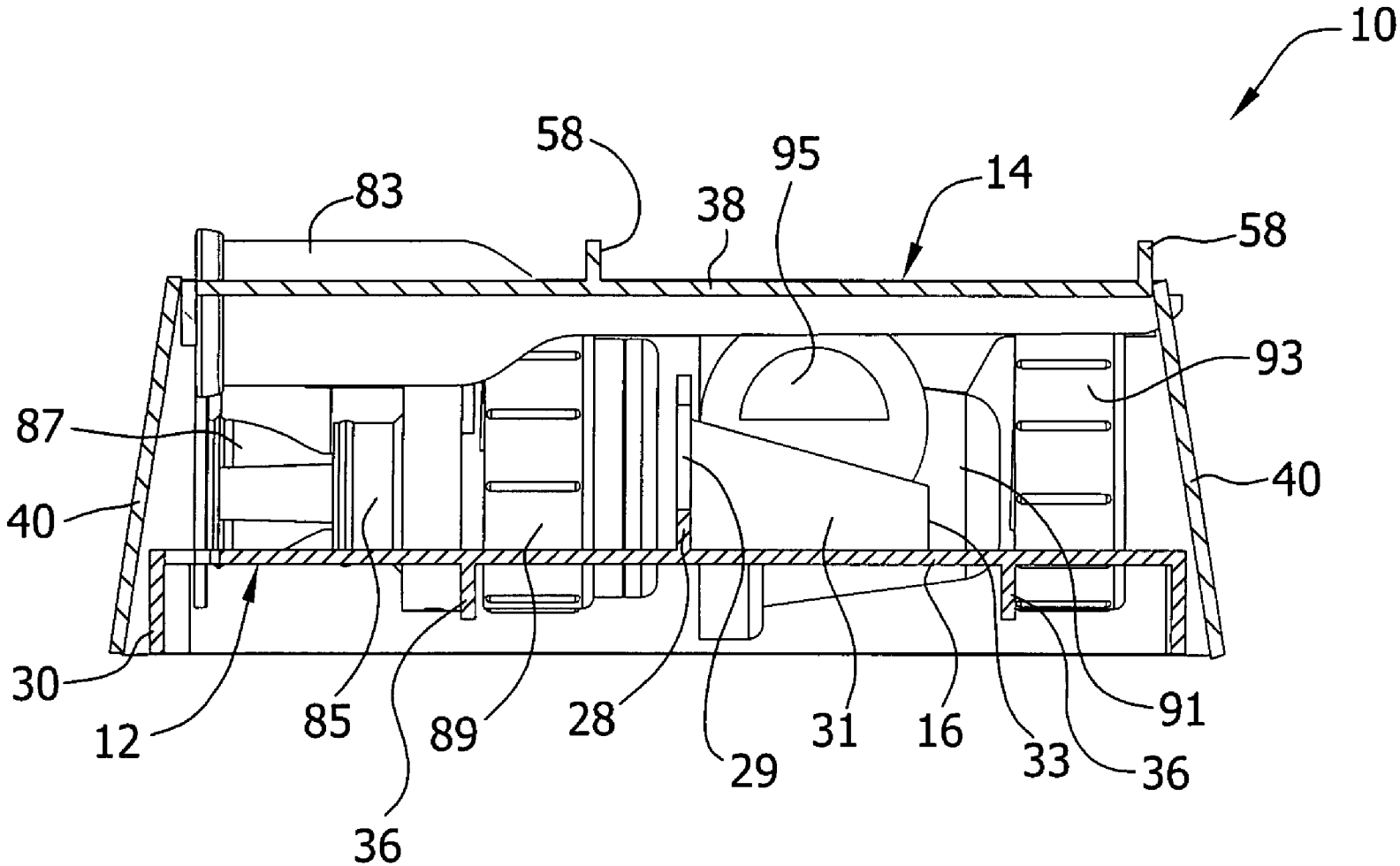
FIG. 4 is a cross-section taken in the plane of line 4-4 of FIG. 3.
Figure 5:
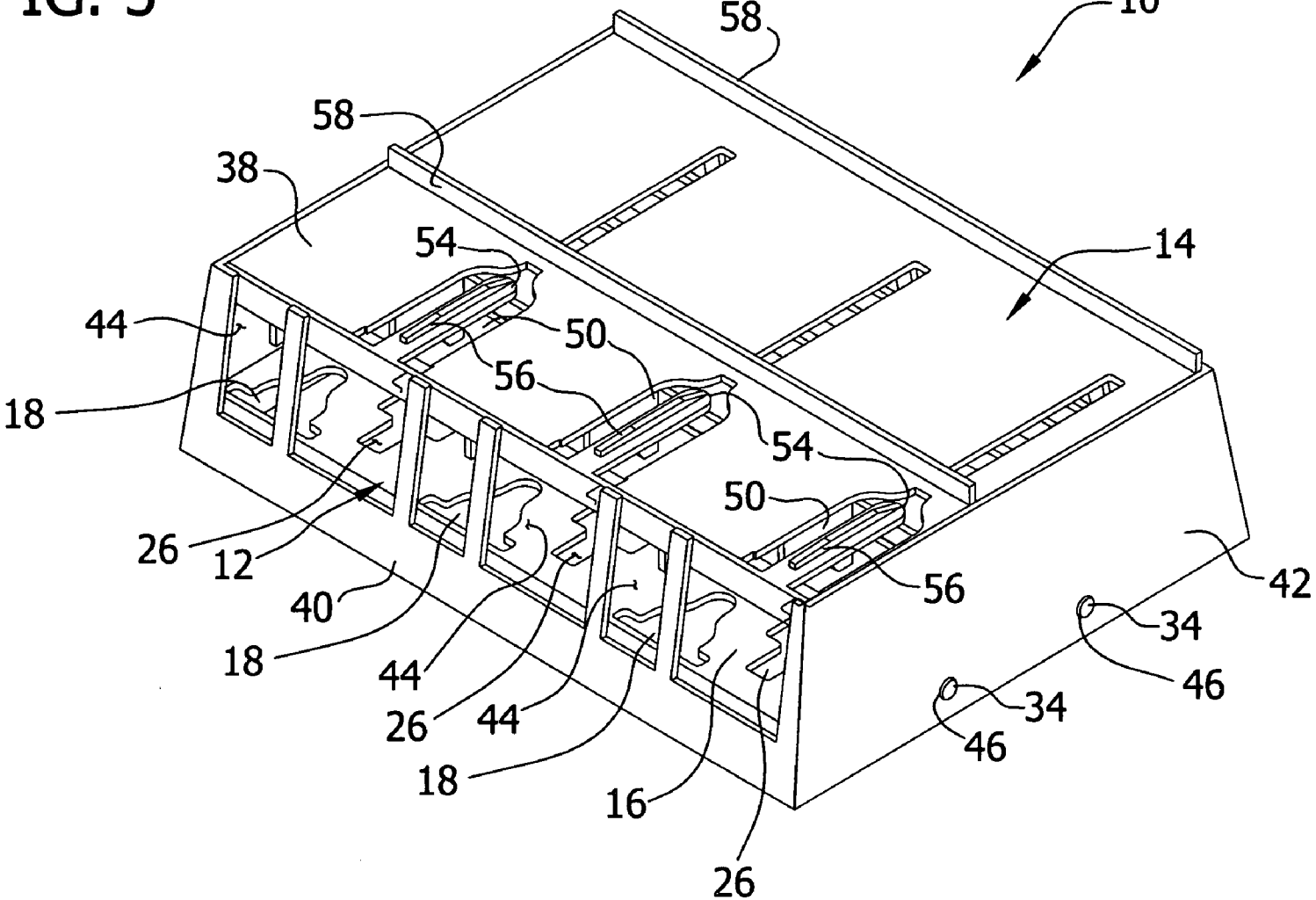
FIG. 5 is a perspective view of the apparatus of FIG. 1 with the various components of the nursing bottle assemblies removed from the apparatus.

With reference again to FIG. 6, it will be understood that the peripheral skirt 30 depending from the panel 16 supports the panel above the surface (e.g., a countertop) on which the loading member is placed during loading to allow sufficient room for the bottle components 80 to properly seat within the openings 18, 20, 22, 24, 26 in the panel as illustrated in FIG. 4. A cut-out 32 (FIG. 2) is provided in the skirt 30 so that a user can grip the retaining member 14 when it is attached to the loading member 12 to facilitate removal of the retaining member from the loading member. The cut-out 32 can also facilitate gripping and picking up the loading member 12 from the supporting surface when the retaining member 14 is not held in assembly with the loading member, and to facilitate holding the loading member 12 while disassembling the retaining member 14 from the loading member following cleaning. While not illustrated in the drawings, additional cut-outs may be provided at locations along the skirt 30.

Figure 8:
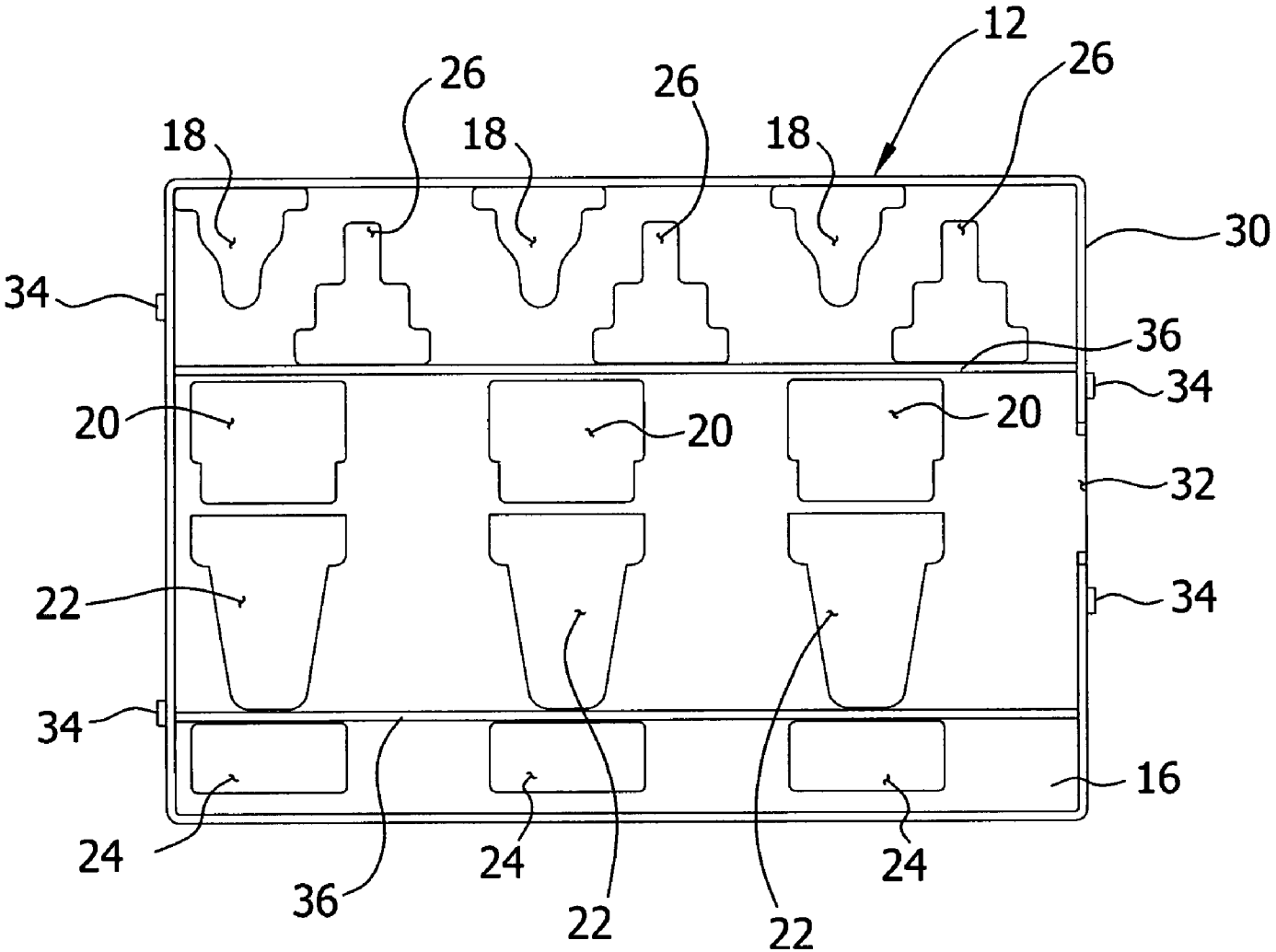
FIG. 8 is a bottom plan view of the loading member.
Figure 9:
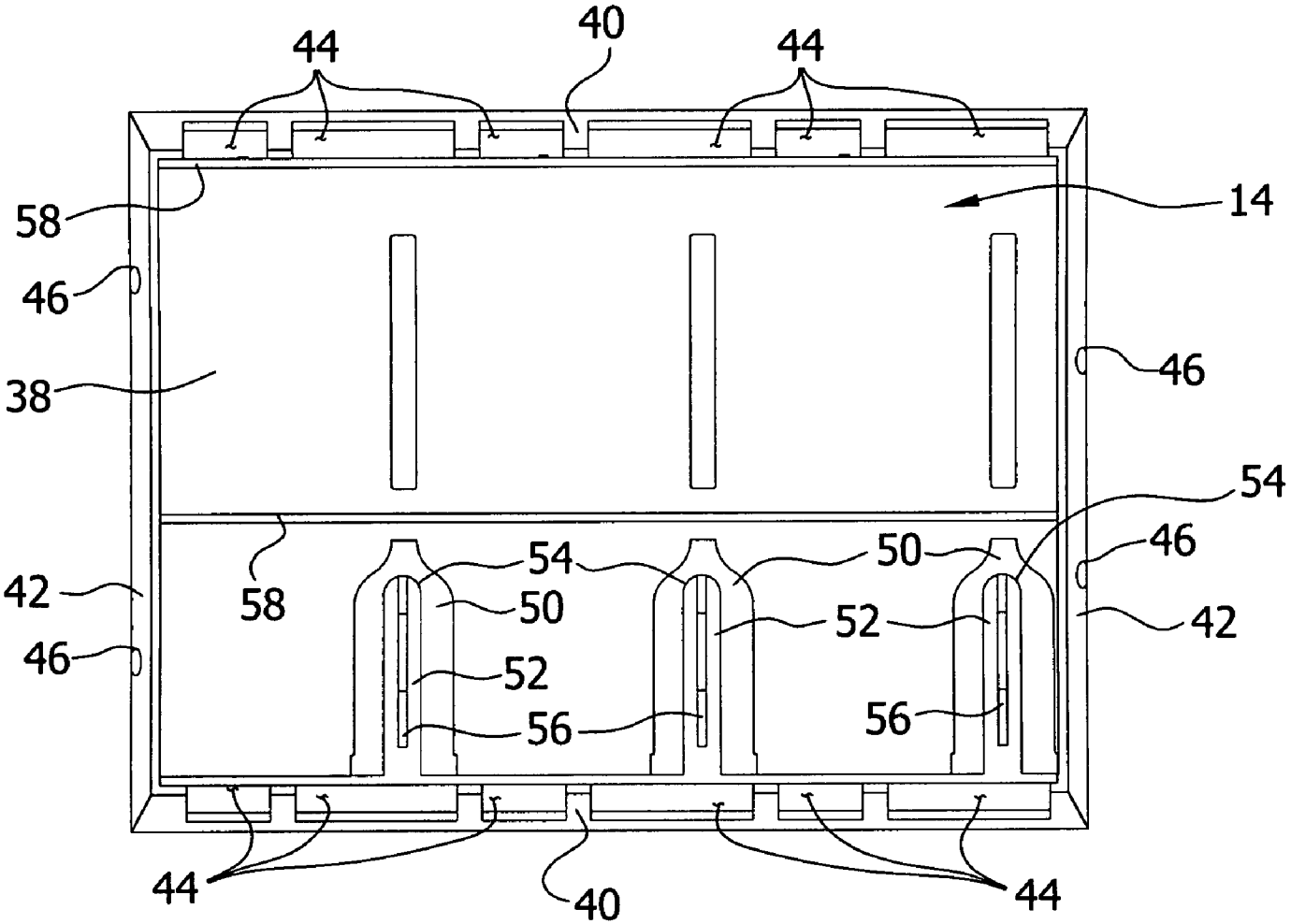
FIG. 9 is a top view of a retaining member of the apparatus.

As illustrated best in FIGS. 4 and 8, a pair of reinforcing ribs 36 depends from the panel 16 and extends longitudinally across the panel, and more suitably to the skirt at opposite sides of the panel for attachment to the skirt as well as the panel. The ribs 36 are suitably located transversely of the panel 16 at locations away from the openings 18, 20, 22, 24, 26. It is understood that the loading member 12 may have more or fewer reinforcing ribs 36, or that the reinforcing ribs 36 may be omitted altogether, without departing from the scope of this invention.

With particular reference now to FIGS. 1-6, 9, and 10, the retaining member 14 suitably comprises (with reference to the orientation of the retaining member as illustrated in FIG. 1) a top wall 38, laterally opposite side walls 40, and longitudinally opposite end walls 42. Each of the side walls 40 and end walls 42 tapers slightly outward they extend downward away from the top wall 38 to defining an open bottom of the retaining member 14 that is sized slightly larger than the loading member 12 for seating the retaining member down over the loading member.

The side walls 40 have a plurality of openings 44 formed therein to permit water in the dishwasher to flow into and outward from the apparatus 10 to clean the bottle components 80 held by the apparatus. For example, in the illustrated embodiment six generally rectangular openings 44 are formed in each of the side walls 40. However, the size, shape and/or number of openings 44 may vary without departing from the scope of this invention. Moreover, the end walls 42 are illustrated as not having any openings formed therein for water flow through, however it is contemplated that openings may be formed in the end walls of the retaining member 14 and remain within the scope of this invention. It is contemplated that one or more openings may also be formed in the top wall 38 of the retaining member 14. In alternative embodiments (not shown), the top wall 38 and or side and end walls 40, 42 of the retaining member 14 may be constructed to have a grid or mesh pattern.

Figure 10:
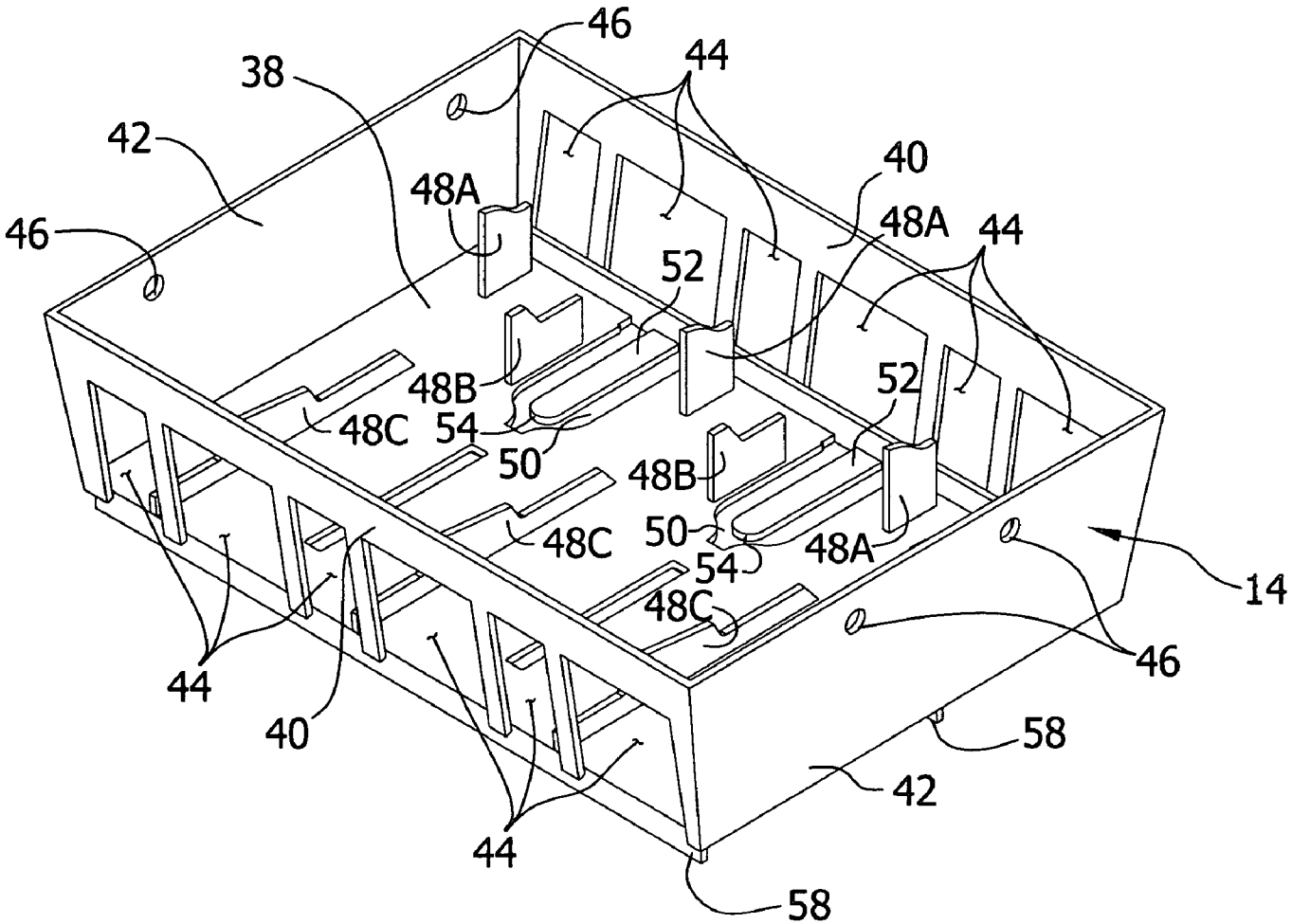
FIG. 10 is a perspective view of the retaining member as illustrated from the bottom of the assembly.

With particular reference to FIG. 10, attached to and depending from the top wall 38 are three sets of laterally extending ribs, such as ribs 48A adjacent one of the side walls 40, ribs 48B spaced laterally from the one side wall, and ribs 48C adjacent the opposite side wall of the retaining member 12. The ribs 48A, 48B, 48C are configured to extend down into closely spaced or even contacting relationship with the various bottle components 80 on the loading member 12 when the retaining member is assembled with the loading member to inhibit movement of the bottle components in the apparatus 10 during cleaning in the dishwasher. For example, the ribs 48A are designed to retain the nipples 87 in place; the ribs 48C are designed to retain the collar 89, cap 91 and a closure or travel cap 93 in place; and the ribs 48B are designed to retain the vent insert 85 in place. As such, upon assembly of the retaining member 14 with the loading assembly 12, the apparatus 10 may be oriented in any manner within the dishwasher, such as with the loading member down, the retaining member down, or the entire apparatus oriented on its side. In the illustrated apparatus 10, however, it is preferred that the side wall 40 adjacent the nipples 87 is position against the upper rack of the dishwasher so that the components 80 of the bottle assemblies 75 adequately drain.

The top wall 38 of the retaining member 14 also includes three sets of openings 50. Each of the openings 50 is sized and shaped for receiving the same component from each of the bottle assemblies 75. For example, in the illustrated embodiment the openings 50 are each sized and shaped for receiving the elongate tubes 83 from each of the bottle assemblies 75. A tab 52 extends laterally from the top wall 38 into each of the openings 50 for mounting the elongate tubes 83 in the openings. Each of the tabs 52 includes a rounded edge 54 for allowing the elongate tube 83 to slide onto the tab and an upwardly extending flange 56 for spacing most of the tube out of contact with the tab.

A pair of laterally spaced reinforcing members 58 (FIGS. 1 and 6) extend longitudinally along the top wall 38 to strengthen the retaining member 14. The reinforcing members 58 suitably extend approximately the entire length of the top wall 38. In particular, one the reinforcing members 58 is positioned adjacent one of the side walls 40 while the other is more centrally located on the top wall 38. It is understood, though, that the top wall 38 can have more or fewer reinforcing members 58, and that the reinforcing members may be located on the top wall 38 at positions other than as shown in the illustrated embodiments without departing from the scope of this invention. It is also understood that the reinforcing members 58 may be omitted from the retaining member 14.

The retaining member 14 is selectively positionable relative to the loading member 12 between an open position in which the loading surface defined by the panel 16 of the loading member is uncovered by the retaining member and therefore accessible for loading and unloading of the bottle components 80, and a closed position in which the retaining member seats down over the loading member to hold the bottle components 80 in place during cleaning.

In one particularly suitable embodiment the retaining member 14 is entirely separable from the loading member 12 in the open position of the retaining member as illustrated in FIG. 2. In such an embodiment, a suitable fastening system is provided to releasably secure the retaining member 14 and loading member 12 in assembly with each other in the closed position of the retaining member. For example, the fastening system of the illustrated embodiment comprises a pair of detents 34 (FIG. 3) secured to and extending outward from the skirt 30 at each of the longitudinal ends of the loading member 12. A corresponding pair of openings 46 is formed in each of the end walls 42 of the retaining member 14. Upon assembly of the retaining member 14 with the loading member 12, the detents 34 seat within the openings 46 to releasably secure the retaining member in assembly with the loading member.

Although two detents 34 and corresponding openings 46 are used as the fastening system in the illustrated embodiment, it is understood that any number of detents may be used, and that the detents may be disposed on the sides of the loading member skirt 30 instead of or in addition to being on the ends thereof. It is also understood that the detents 34 may be on the retaining member 14 and the corresponding openings may be on the skirt 30 of the loading member 12. It is also contemplated that fastening systems other than detent/opening fastenings may be used to releasably secure the retaining member 14 and the loading member 12 in assembly with each other.

Figure 3:
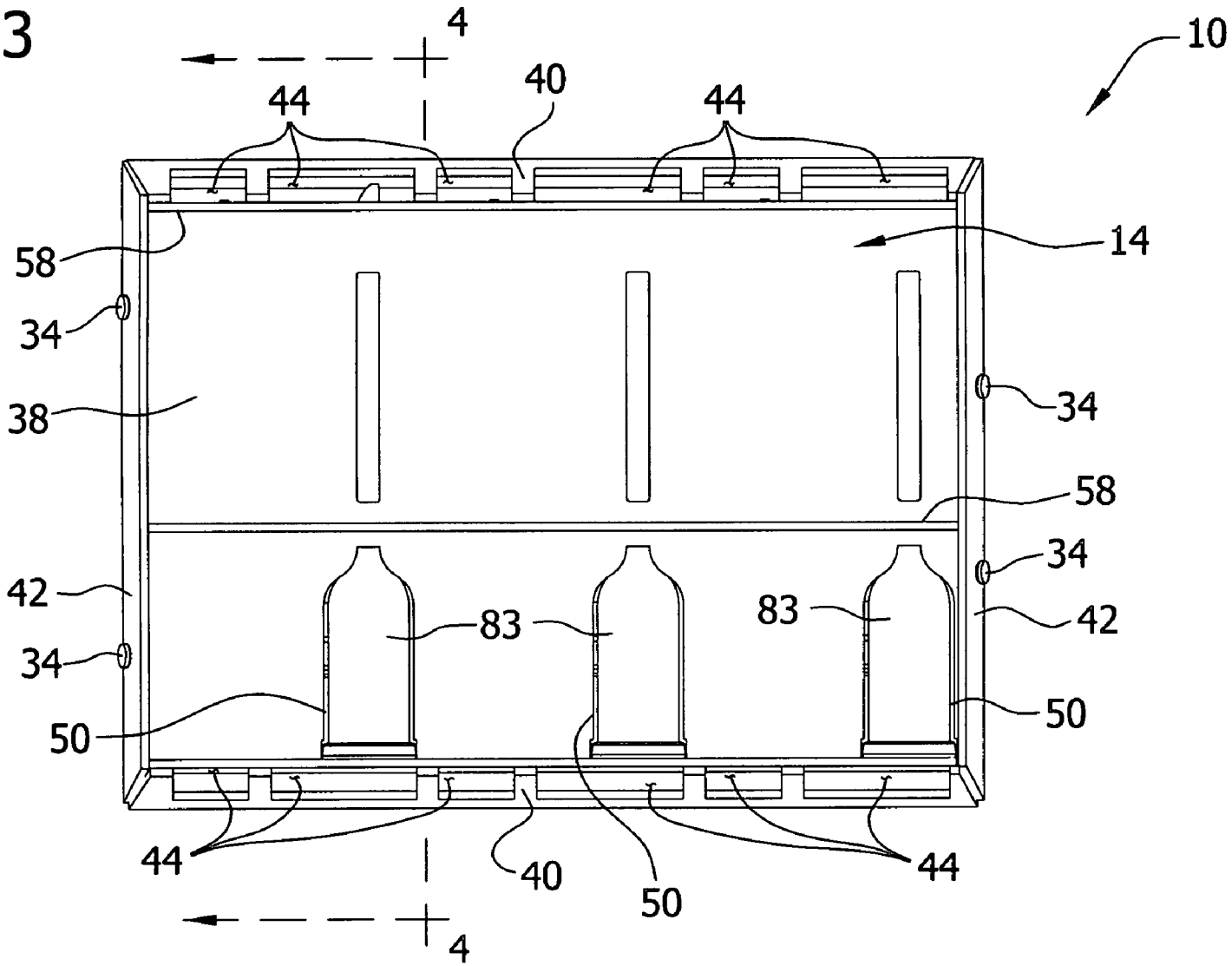
FIG. 3 is a top view of the apparatus of FIG.1.

In one particularly suitable embodiment, the fastening system is configured so that the retaining member 14 is positionable on the loading member 12 in only one orientation of the retaining member to properly fasten the retaining member to the loading member. For example, in the illustrated embodiment of FIG. 3 the detents 34 (and corresponding openings 46) at one end of the apparatus 10, such as the left end in FIG. 3, are spaced from each other a greater distance than the detents (and corresponding openings) at the opposite end of the apparatus (e.g., the right end in FIG. 3). Accordingly, the retaining member 14 can only properly fasten to the loading member when the retaining member is oriented with the wider spaced openings 46 at the same end as the wider spaced detents 34 of the loading member. By requiring this orientation, the retaining member is properly positioned on the loading member to positively hold the bottle components 80 in the apparatus during cleaning.

As illustrated in FIG. 7, the loading member 12 can include indicia 60 thereon for facilitating identification of the respective opening 18A-26C as being the proper location for the placement of the respective component. For example, the indicia 60 can be the respective names of the component intended to be placed into the opening 18A-26C. The indicia 60 could also include a color, picture, number, or any other indicia that can be used to identify the component intended to be placed in the respective opening 18A-26C. Indicia (not shown) can also be placed on the retaining member 14 to identify which component(s) of the bottle assemblies 75 are intended to be seated in the openings 50 in the retaining member.

FIGS. 13-24 illustrate a second embodiment of apparatus, generally indicated at 110 similar to the apparatus 10 of the first embodiment except that the apparatus is suitably configured to hold bottle components 180 (e.g., components 183, 185, 187, 189, 191, 193, 195, other than bottle 177) of a wide-neck type nursing bottle assembly 175 such as that available Handi-Craft Company of Saint Louis, Mo. under the tradename DR. BROWN'S NATURAL FLOW. As a result, the apparatus, including the loading member 112 and retaining member 114 are sized and shaped differently than the corresponding parts of the apparatus 10 to accommodate the different sized and shaped bottle components 180. Parts of the apparatus 110 and bottle assemblies 175 shown in FIGS. 13-24 corresponding to parts of the apparatus 10 and bottle assemblies 75 shown in FIGS. 1-12 are identified using the same references number plus "100".

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. Apparatus for holding components of a nursing bottle assembly in a dishwasher, the nursing bottle assembly comprising a bottle, at least a first component adapted for assembly with the bottle and at least a second component different from the first component and adapted for assembly with the bottle, the apparatus comprising:

a loading member having in a loading configuration thereof a first opening sized and configured for individually receiving a portion of the first component therethrough to seat the first component on the loading member, and a second opening separate from the first opening and being sized and configured for individually receiving a portion of the second component therethrough to seat the second component on the loading member, the first and second openings differing in at least one characteristic indicative of the respective first and second components to facilitate identification of the first opening as being the proper location on the loading member for placement of the first component and of the second opening as being the proper location on the loading member for placement of the second component.

2. The apparatus set forth in claim 1 wherein the at least one characteristic comprises the shape of the first and second openings, the first opening having a shape corresponding generally to a profile of the first component and the second opening having a shape corresponding generally to a profile of the second component.

3. The apparatus set forth in claim 2 wherein the first component of the nursing bottle assembly is a nipple and the second component of the nursing bottle assembly is a collar, the first opening having a shape corresponding generally to the profile of the nipple and the second opening having a shape corresponding generally to the profile of the collar.

4. The apparatus set forth in claim 1 wherein the apparatus is capable of holding the first and second components of a plurality of nursing bottle assemblies, the loading member of the apparatus comprising a plurality of the first openings and a plurality of the second openings, each of the first openings being separate and spaced from each of the other first openings, and each of the second openings being separate and spaced from each of the other second openings.

5. The apparatus set forth in claim 1 further comprising a retaining member moveable relative to the loading member between an open position defining the loading configuration of the loading member to permit loading of the first and second components onto the loading member and a closed position for use of the apparatus in the dishwasher during operation thereof, in the closed position of the retaining member the first and second components being generally inhibited against movement relative to the loading member and the retaining member during operation of the dishwasher.

6. The apparatus set forth in claim 5 wherein the retaining member is adapted to overlay the loading member in the closed position of the retaining member, the retaining member having at least one rib depending therefrom for contacting at least one of the first and second components in the closed position of the retaining member.

7. The apparatus set forth in claim 6 wherein the retaining member comprises at least one first rib depending therefrom and at least one second rib depending therefrom and having at least one of a shape, size and orientation different from that of the first rib.

8. The apparatus set forth in claim 5 wherein the retaining member is releasably attachable to the loading member in the closed position of the retaining member.

9. The apparatus set forth in claim 8 wherein the retaining member is entirely separable from the loading member, said apparatus further comprising a fastening system for releasably attaching the loading member to the retaining member in the closed position of the loading member.

10. The apparatus set forth in claim 9 wherein the retaining member is configured for disposition in a single orientation relative to the loading member in the closed position of the retaining member, the fastening system being inoperable when the retaining member is other than in said single orientation relative to the loading member.

11. Apparatus for holding components of a nursing bottle assembly in a dishwasher, the nursing bottle assembly comprising a bottle, at least a first component adapted for assembly with the bottle and at least a second component different from the first component and adapted for assembly with the bottle, the apparatus comprising:

a loading member having in a loading configuration thereof a first opening sized and configured exclusively for receiving a portion of the first component therethrough to individually seat the first component on the loading member, and a second opening separate from the first opening and being sized and configured exclusively for receiving a portion of the second component therethrough to individually seat the second component on the loading member; and a retaining member moveable relative to the loading member between an open position defining the loading configuration of the loading member to permit loading of the first and second components onto the loading member and a closed position for use of the apparatus in the dishwasher during operation thereof, in the closed position the retaining member contacting the first and second components such that the loading member and the retaining member together generally inhibit movement of the first and second components relative to the loading member and the retaining member during operation of the dishwasher.

12. The apparatus set forth in claim 11 wherein the retaining member is adapted to overlay the loading member in the closed position of the retaining member, the retaining member having a first rib depending therefrom and at least one second rib depending therefrom and having at least one of a shape, size and orientation different from that of the first rib, each of the first and second ribs contacting at least one of the first and second components in the closed position of the retaining member.

13. The apparatus set forth in claim 11 wherein the retaining member is releasably attachable to the loading member in the closed position of the retaining member.

14. The apparatus set forth in claim 11 wherein the retaining member is entirely separable from the loading member, said apparatus further comprising a fastening system for releasably attaching the loading member to the retaining member in the closed position of the loading member.

15. The apparatus set forth in claim 14 wherein the retaining member is configured for disposition in a single orientation relative to the loading member in the closed position of the retaining member, the fastening system being inoperable to attach the retaining member to the loading member when the retaining member is other than in said single orientation relative to the loading member.

16. The apparatus set forth in claim 15 wherein the fastening system comprises a pair of first fasteners disposed on the retaining member, said first fasteners being spaced from each other a first distance, a pair of second fasteners disposed on the retaining member separate from the first fasteners and spaced from each other a second distance different from the first fasteners, a pair of third fasteners disposed on the loading member, said third fasteners being spaced from each other said first distance and adapted for attachment to the first fasteners in the closed position of the retaining member, and a pair of fourth fasteners disposed on the retaining member, said fourth fasteners being separate from the third fasteners and spaced from each other said second distance and adapted for attachment to the second fasteners in the closed position of the retaining member.

17. The apparatus set forth in claim 11 wherein the retaining member is configured such that in the closed position of the retaining member the loading member and the retaining member together substantially enclose the first and second components within the apparatus.

18. Apparatus for holding components of a nursing bottle assembly in a dishwasher, the nursing bottle assembly comprising a bottle, at least a first component adapted for assembly with the bottle and at least a second component different from the first component and adapted for assembly with the bottle, the apparatus comprising:

a loading member having in a loading configuration thereof a first opening sized and configured for receiving a portion of the first component therethrough to individually seat the first component on the loading member, a second opening separate from the first opening and being sized and configured for receiving a portion of the second component therethrough to individually seat the second component on the loading member, indicia on the loading member facilitating identification of the first opening as being the proper location on the loading member for placement of the first component and of the second opening as being the proper location on the loading member for placement of the second component.

19. The apparatus set forth in claim 18 wherein the indicia comprises the respective names of the first and second components.

20. The apparatus set forth in claim 18 wherein the indicia comprises a first color at the first opening and corresponding to the first component and a second color at the second opening and corresponding to the second component.

* * * * *

UNITED STATES PATENT AND TRADEMARK OFFICE

CERTIFICATE OF CORRECTION

PATENT NO. : 7,650,896 B2
APPLICATION NO. : 11/411368
DATED : January 26, 2010
INVENTOR(S) : Kemper et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 446 days.

Signed and Sealed this

Twenty-eighth Day of December, 2010

David J. Kappos

David J. Kappos
*Director of the United States Patent and Trademark Office*